US009858886B2

(12) United States Patent
Bae et al.

(10) Patent No.: US 9,858,886 B2
(45) Date of Patent: Jan. 2, 2018

(54) METHOD, APPARATUS, AND STORAGE MEDIUM FOR COMPENSATING FOR DEFECTIVE PIXEL OF DISPLAY

(71) Applicant: Samsung Electronics Co., Ltd., Gyeonggi-do (KR)

(72) Inventors: Jong-Kon Bae, Seoul (KR); Soo-Hyung Kim, Gyeonggi-do (KR); Yong-Man Lee, Gyeonggi-do (KR); Sung-Dae Cho, Gyeonggi-do (KR); Seok-Jin Han, Gyeonggi-do (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 121 days.

(21) Appl. No.: 14/324,024

(22) Filed: Jul. 3, 2014

(65) Prior Publication Data

US 2015/0154933 A1 Jun. 4, 2015

(30) Foreign Application Priority Data

Dec. 3, 2013 (KR) ..... 10-2013-0149232

(51) Int. Cl.

| | |
|---|---|
| ***G09G 5/02*** | (2006.01) |
| ***G09G 5/00*** | (2006.01) |
| ***G09G 3/20*** | (2006.01) |
| ***G09G 3/3208*** | (2016.01) |
| ***G09G 3/36*** | (2006.01) |

(52) U.S. Cl.

CPC ..... *G09G 5/00* (2013.01); *G09G 3/2003* (2013.01); *G09G 3/3208* (2013.01); *G09G 3/3611* (2013.01); *G09G 5/02* (2013.01); *G09G 2330/08* (2013.01); *G09G 2330/10* (2013.01); *G09G 2360/147* (2013.01)

(58) Field of Classification Search

CPC ..... G06T 5/00; G09G 5/00; G09G 5/02
USPC ..... 345/618
See application file for complete search history.

(56) References Cited

U.S. PATENT DOCUMENTS

| | | | | |
|---|---|---|---|---|
| 6,618,115 | B1 * | 9/2003 | Hiroki | G09G 3/002 324/760.01 |
| 7,911,432 | B2 * | 3/2011 | Keeney | G02F 1/136259 324/760.01 |
| 2004/0080479 | A1 * | 4/2004 | Credelle | G02F 1/133514 345/88 |
| 2007/0030229 | A1 * | 2/2007 | Liu | G09G 3/20 345/90 |
| 2007/0109327 | A1 * | 5/2007 | Cok | G09G 3/2003 345/690 |

(Continued)

OTHER PUBLICATIONS

Post, Williams. English Translation of Foreign Patent Document EP 1250000 A2. Oct. 16, 2002. pp. 1-13.*

*Primary Examiner* — Barry Drennan
*Assistant Examiner* — Terrell Robinson

(57) ABSTRACT

Provided is a method for compensating for a defective pixel of a display. The method includes identifying at least one of a plurality of pixels of a display as a defective pixel and compensating for a function of the defective pixel by using at least one pixel from a first pixel group located in a first partial region corresponding to the defective pixel and a second pixel group located in a second partial region located adjacent to the first partial region among a plurality of partial regions, each partial region comprising some adjacent pixels among the plurality of pixels.

18 Claims, 10 Drawing Sheets

(56) References Cited

U.S. PATENT DOCUMENTS

| | | | | |
|---|---|---|---|---|
| 2007/0257866 | A1* | 11/2007 | Cok | G09G 3/20 345/76 |
| 2011/0149123 | A1* | 6/2011 | Matsuoka | H04N 5/367 348/247 |
| 2013/0147858 | A1* | 6/2013 | Omoto | G09G 3/30 345/690 |

* cited by examiner

METHOD, APPARATUS, AND STORAGE MEDIUM FOR COMPENSATING FOR DEFECTIVE PIXEL OF DISPLAY

CROSS-REFERENCE TO RELATED APPLICATION(S) AND CLAIM OF PRIORITY

The present application is related to and claims the benefit under 35 U.S.C. §119(a) of a Korean patent application filed in the Korean Intellectual Property Office on Dec. 3, 2013 and assigned Serial No. 10-2013-0149232, the entire disclosure of which is incorporated herein by reference.

TECHNICAL FIELD

The present disclosure relates to a method and apparatus for compensating for pixels of a display.

BACKGROUND

A display refers to a device that expresses visual information, for example, images or videos. A recent display has evolved from a level expressing images or videos two-dimensionally to a level expressing visual information three-dimensionally for allowing depth perception or stereovision. A display provided with an electric signal as input information can be referred to as an "electronic display".

There are types of electronic displays: a Liquid Crystal Display (LCD), a Light-Emitting Diode (LED), an Organic LED (OLED), and electronic paper. Among these types of electronic displays, an LCD and an OLED are often used.

For example, in an LCD, a plurality of liquid crystal pixels can be arranged in a matrix form on a substrate, and two transparent electrodes can be connected to each of the liquid crystal pixels. Polarizing filters can be arranged at both sides of each liquid crystal pixel such that their polarization axes are perpendicular to each other. In a normal state, the specific arrangement of the liquid crystal pixels can pass light through the polarizing filters, but if voltage is applied to the transparent electrodes of each liquid crystal pixel, the arrangement of the liquid crystal pixels can be fixed to block light without passing light.

An electronic display of a type different from that of an LCD can be, for example, an OLED. The OLED can produce light in LEDs by using an organic compound. Thus, in the OLED, the expression range of light can be wider than that of the LCD. The OLED can express a color using a scheme, for example, a three-color scheme, a conversion scheme, or a color filter scheme. The three-color scheme can implement various colors by using light-emitting layers having different colors of red, green, and blue. In the three-color scheme, the purity of a color can be improved using a color filter to be described below. The conversion scheme can implement a color such as red or green by passing at least a part of light produced, for example, in a light-emitting layer of blue, through a color conversion layer. The color filter scheme can implement a color corresponding to each color filter by passing at least a part of light produced, for example, in a light-emitting layer of white, through color filters of various colors such as red, green, or blue.

Various types of displays, as well as the foregoing LCD and OLED, can be applied to electronic devices.

In a process of manufacturing a display or using a display by a user, various types of defective pixels can be generated. Defective pixels can be a hot pixel that is turned on at all times, a dead pixel that is turned off at all times, and a stuck pixel that can be turned on or off, regardless of an input signal for the pixel.

In the manufacturing process of the display, a display panel can be produced and released to the market after removing a defective pixel therefrom, according to the internal standard of a display manufacturer. Therefore, a defective pixel generated in a display panel during the manufacturing process can directly affect the yield and profit of the display manufacturer.

During the user's using process, defective pixels can be generated for various reasons, such as performance deterioration due to use, pressure, shocks, and so forth. The defective pixels generated during the using process can degrade user's satisfaction with product quality. Replacement or disposal of a display panel in which a defective pixel is found can increase the cost of post management of the manufacturer. Moreover, along with the tendency of display development toward high resolution and large size, the possibility of a defective pixel in the display panel can increase further.

The above information is presented as background information only to assist with an understanding of the present disclosure. No determination has been made, and no assertion is made, as to whether any of the above might be applicable as prior art with regard to the present disclosure.

SUMMARY

To address the above-discussed deficiencies, it is a primary object to provide an apparatus and method for compensating for a function of a defective pixel generated in a display panel of an electronic device.

In a first example, there is provided a method for compensating for a defective pixel of a display. The method includes, as a defective pixel, at least one of a plurality of pixels of a display. The method also includes compensating a function of the defective pixel using at least one pixel from a first pixel group formed in a first partial region corresponding to the defective pixel, or a second pixel group formed in a second partial region adjacent to the first partial region among a plurality of partial regions.

In a second example, there is provided an electronic device. The electronic device includes a display panel driven by each of a plurality of control signals corresponding to a plurality of pixels. The electronic device also includes an identification module configured to identify, as a defective pixel, at least one of the plurality of pixels. The electronic device further includes a compensation module configured to compensate a function of the defective pixel using at least one pixel from a first pixel group formed in a first partial region corresponding to the defective pixel, or a second pixel group formed in a second partial region adjacent to the first partial region among a plurality of partial regions.

Other aspects, advantages, and salient features of the disclosure will become apparent to those skilled in the art from the following detailed description, which, taken in conjunction with the annexed drawings, discloses exemplary embodiments of the disclosure.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

Throughout the drawings, like reference numerals will be understood to refer to like parts, components, and structures.

DETAILED DESCRIPTION

Figure 1:
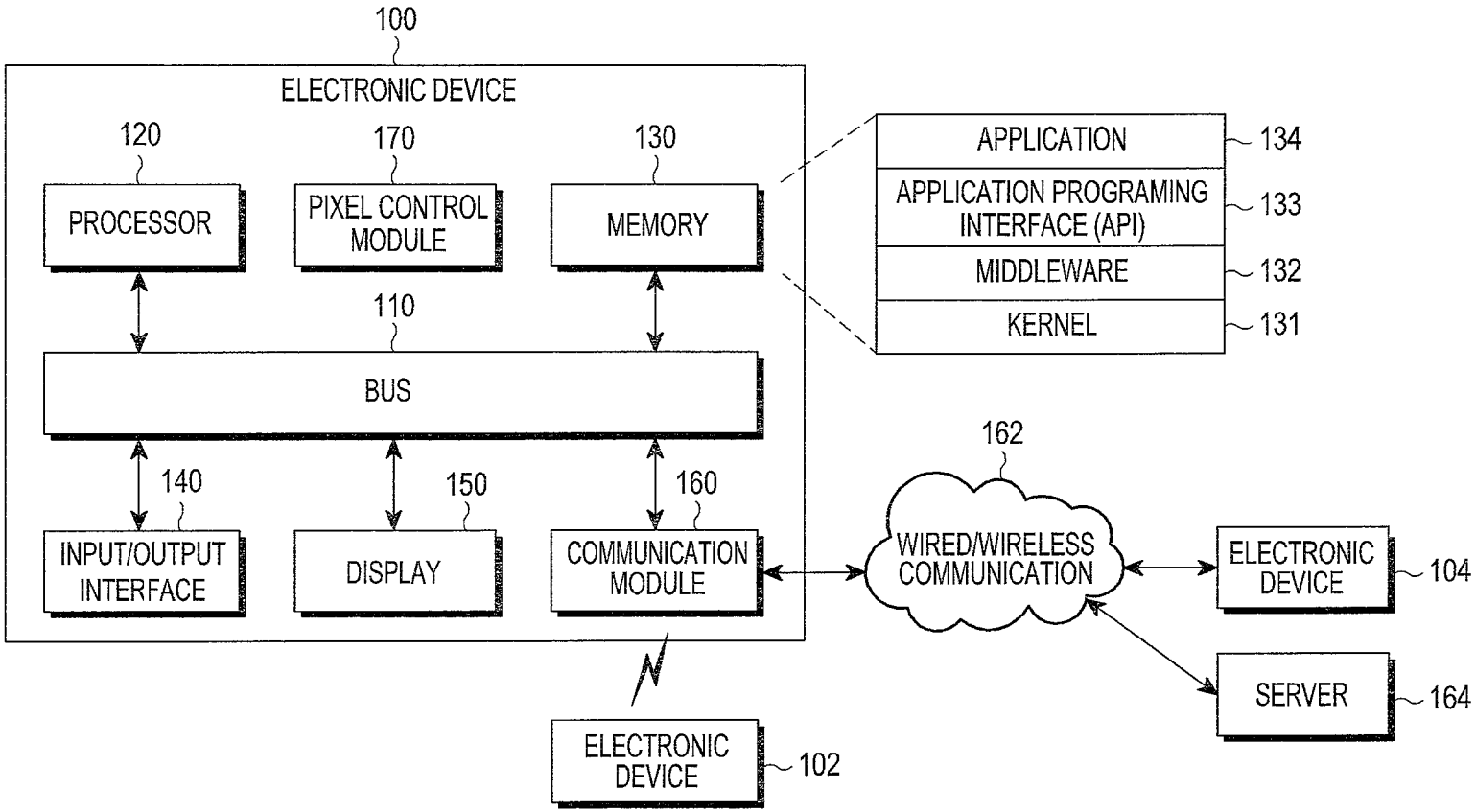
FIG. 1 is an example block diagram illustrating an electronic device according to the present disclosure.

FIGS. 1 through 9, discussed below, and the various embodiments used to describe the principles of the present disclosure in this patent document are by way of illustration only and should not be construed in any way to limit the scope of the disclosure. Those skilled in the art will understand that the principles of the present disclosure can be implemented in any suitably arranged electronic device. Hereinafter, various embodiments of the present disclosure will be described in relation to the accompanying drawings. The various embodiments of the present disclosure can be changed variously and can have a variety of embodiments, such that particular embodiments have been illustrated in the drawings and a related detailed description thereof will be provided below. However, this is not intended to limit the various embodiments to particular embodiments, and should be understood that all changes, equivalents, or substitutes included in the spirit and technical scope of the present disclosure are included in the scope of the present disclosure. In the following description of the present disclosure, a detailed description of known functions and configurations incorporated herein will be omitted when it can obscure the subject matter of the present disclosure. In the following description, only parts necessary for understanding operations of the present disclosure will be described, and a detailed description of known functions and configurations incorporated herein will be omitted so as not to make the subject matter of the present disclosure unclear.

Terms "include" or "can include" used in various embodiments of the present disclosure indicate an existence of disclosed function, operation, or component, but do not limit an existence of one or more other functions, operations, or components. Terms "include" or "has" used in the present disclosure should be understood that they are intended to indicate an existence of feature, number, step, operation, component, item or any combination thereof, disclosed in the specification, but should not be understood that they are intended to previously exclude an existence of one or more other features, numbers, steps, operations, components, or any combination thereof or possibility of adding those things.

An electronic device according to various embodiments of the present disclosure can be a device having a communication function. For example, the electronic device can include at least one of a smart phone, a tablet Personal Computer (PC), a mobile phone, a video phone, an electronic (e-)book reader, a desktop PC, a laptop PC, a netbook computer, a Personal Digital Assistant (PDA), a Portable Multimedia Player (PMP), an MP3 player, mobile medical equipment, a camera, a wearable device (for example, a Head-Mounted Device (HMD) such as electronic glasses), an electronic cloth, an electronic bracelet, an electronic necklace, an electronic appcessory, an electronic tattoo, or a smart watch.

According to some embodiments, the electronic device can be a smart home appliance having a communication function. The smart home appliance can include, for example, a Television (TV), a Digital Video Disk (DVD) player, audio equipment, a refrigerator, an air conditioner, a vacuum cleaner, an oven, a microwave oven, a laundry machine, an air cleaner, a set-top box, a TV box (for example, HomeSync™ of Samsung, TV™ of Apple, or TV™ of Google), a game console, an electronic dictionary, an electronic key, a camcorder, or an electronic frame.

According to some embodiments, the electronic device can include at least one of various medical equipment (for example, Magnetic Resonance Angiography (MRA), Magnetic Resonance Imaging (MRI), Computed Tomography (CT), an imaging device, or an ultrasonic device), a navigation system, a Global Positioning System (GPS) receiver, an Event Data Recorder (EDR), a Flight Data Recorder (FDR), a vehicle infotainment device, electronic equipment for ships (for example, navigation system and gyro compass for ships), avionics, or a security device.

According to some embodiments, the electronic device can include a part of a furniture or building/structure having a communication function, an electronic board, an electronic signature receiving device, a projector, or various measuring instruments (for example, a water, electricity, gas, or electric wave measuring device). The electronic device according to the present disclosure can be one of the above-listed devices or a combination thereof. It will be obvious to those of ordinary skill in the art that the electronic device according to the present disclosure is not limited to the above-listed devices. Hereinafter, the electronic device according to various embodiments will be described with reference to the accompanying drawings. The term "user" used in the various embodiments can indicate a person who uses the electronic device or a device (for example, an artificial intelligence electronic device) which uses the electronic device.

FIG. 1 is an example block diagram illustrating an electronic device 100 according to the present disclosure. Referring to FIG. 1, the electronic device 100 can include a bus 110, a processor 120, a memory 130, an input/output interface 140, a display 150, a communication module 160, or a pixel control module 170.

The bus 110 can be a circuit for connecting the foregoing elements with each other and delivering communication (for example, a control message) between the components.

The processor 120 can be configured to receive a command from one of the above-described other components (for example, the memory 130, the input/output interface 140, the display 150, or the communication module 160) through the bus 110, decrypt the received command, and execute an operation or data processing corresponding to the decrypted command.

The memory 130 can be configured to store a command or data received from or generated by the processor 120 or another component (for example, the input/output interface 140, the display 150, and/or the communication module 160). The memory 130 can include programming modules, for example, a kernel 131, a middleware 132, an Application Programming Interface (API) 133, or at least one application 134. each of these programming modules can include software, firmware, hardware, or a combination of at least two of them.

The kernel 131 can be configured to control or manage system resources (for example, the bus 110, the processor 120, or the memory 130) used to execute an operation or a function implemented in another programming module, for example, the middleware 132, the API 133, or the applications 134. The kernel 131 can be configured to provide an interface through which the middleware 132, the API 133, or the applications 134 accesses a separate component of the electronic device 100 to control the separate component.

The middleware 132 can be configured to perform a relay operation such that the API 133 or the applications 134 exchanges data in communication with the kernel 131. The middleware 132 can be configured to perform load balancing among task requests received from the applications 134, by using a method of assigning a priority for using a system resource (for example, the bus 110, the processor 120, or the memory 130) of the electronic device 100 to, for example, at least one of the applications 134.

The API 133 can be an interface through which the application 134 controls a function provided by the kernel 131 or the middleware 132, and can include at least one interface or function for, for example, file control, window control, image processing or character control.

The input/output interface 140 can be configured to receive a command or data from a user and deliver the received command or data to the processor 120 or the memory 130 through the bus 110. The display 150 can be configured to display an image, video, or data to the user.

The communication module 160 can be configured to connect communication between another electronic device 102 and 104 or a server 164 and the electronic device 100. The communication module 160 can be configured to support wired/wireless communication 162 such as predetermined short-range wired/wireless communication (for example, Wireless Fidelity (WiFi), Bluetooth (BT) or Near Field Communication (NFC)) or predetermined network communication (for example, Internet, a Local Area Network (LAN), a Wide Area Network (WAN), a telecommunication network, a cellular network, a satellite network, a Universal Serial Bus (USB), Recommended Standard (RS)-232, or a Plain Old Telephone Service (POTS)). Each of the electronic devices 102 and 104 can be the same (for example, have the same type) as or can be different (for example, have a different type) from the electronic device 100.

The pixel control module 170 can be configured to compensate for a defective pixel generated in the display 150, based on information about a defective pixel (or defective pixel information) which is received from another component (for example, the bus 110, the memory 130, the input/output interface 140, or the communication module 160) or which is previously stored. In relation to FIGS. 2 through 8, the pixel control module 170 will be further described.

Figure 2:
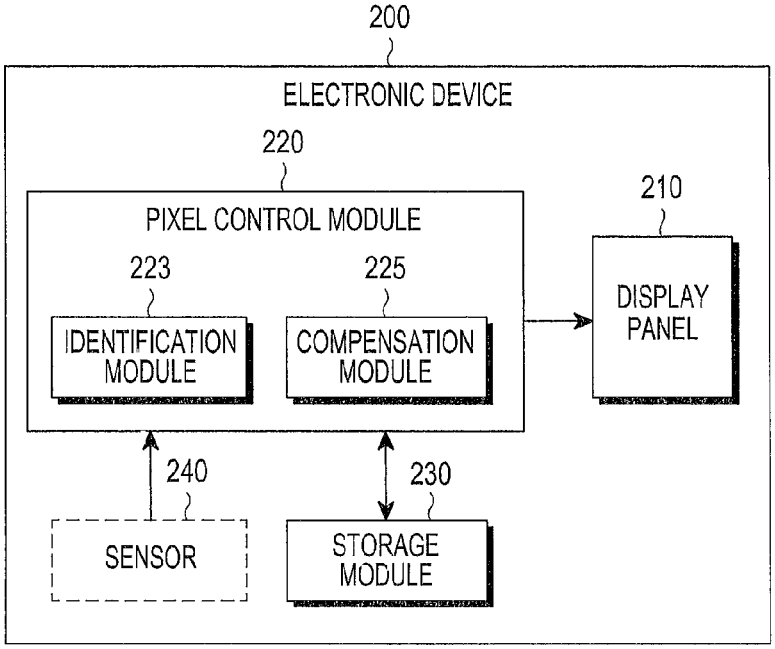
FIG. 2 is an example block diagram illustrating an electronic device for compensating for a pixel according to the present disclosure.

FIG. 2 is an example block diagram illustrating an electronic device 200 for pixel compensation according to the present disclosure. The electronic device 200 can be, for example, the electronic device 100 illustrated in FIG. 1. Referring to FIG. 2, the electronic device 200 can include a display panel 210, a pixel control module 220, and a storage module 230. In an embodiment, the electronic device 200 can further include a sensor 240.

In an embodiment, the display panel 210 can be at least a part of the display 150 illustrated in FIG. 1. The display panel 210 can be driven by a plurality of control signals corresponding to a plurality of pixels, respectively. The electronic device 200 can compensate for a function of at least one defective pixel generated among a plurality of pixels included in the display panel 210.

In an embodiment, the plurality of pixels can include normal pixels implementing an expression function corresponding to physical characteristics (for example, resolution, horizontal resolution, vertical resolution, or a Pixel Per Inch (PPI)) of the display panel 210 and redundancy cell or redundancy pixels disposed between the normal pixels to compensate for or strengthen expression functions of neighboring normal pixels.

In an embodiment, the pixel control module 220 can include an identification module 223 and a compensation module 225. The pixel control module 220 can be the pixel control module 170 illustrated in FIG. 1. The pixel control module 220 can also be at least a part of the processor 120 and/or a Display Driver Integrated Circuit (DDI, not shown) for driving the display 150 illustrated in FIG. 1. The pixel control module 220 can include a combination of one or two of hardware, software, or firmware.

In an embodiment, the identification module 223 can be configured to receive a command or information from, for example, another component (for example, the processor 120, the memory 130, the input/output interface 140, the display 150, or the communication module 160). For example, the identification module 223 can be configured to receive a command or information related with the display 150 from at least one of the processor 120, the input/output interface 140, or the communication module 160 illustrated in FIG. 1, through a display interface protocol having one or more of various standards, such as a Mobile Industry Processor Interface (MIPI), Red/Green/Glue (RGB) interface, a Central Processing Unit (CPU) interface, a Mobile Display Digital (MDD) interface, a Serial Peripheral (SP) interface, or an Inter Integrated Circuit ($I^2C$).

The identification module 223 can be configured to identify at least one of a plurality of pixels of the display panel 210 as a defective pixel. In an embodiment, the identification module 223 can be configured to obtain information about the defective pixel. The defective pixel information can be, for example, information indicating at least one of the plurality of pixels of the display panel 210. At least a portion of the defective pixel information can be, for example, coordinates and a color of the defective pixel. A defective pixel specified by the information can be a pixel in a particular color, which belongs to a pixel group corresponding to particular coordinates. At least a portion of the defective pixel information can be, for example, a position of the defective pixel. The position of the defective pixel can be absolute position information indicating a particular point on the display panel 210 or relative position information indicating a particular point corresponding to a relative position between a predefined reference point and the particular point. At least a portion of the defective pixel information can be, for example, an identifier of the defective pixel. The defective pixel information can further include, for example, a total number of defective pixels. The identification module 223 can be configured to receive the defective pixel information from the sensor 240 (for example, a touch sensor or a pen sensor) functionally connected with the electronic device 200. In an embodiment, the identification module 223 can be configured to obtain the defective pixel information from the storage module 230. The identification module 223 can also be configured to obtain the defective pixel information from another component (for example, the processor, the memory, the input/output interface, the display, or the communication module) of the electronic device.

In an embodiment, the identification module 223 can be configured to receive information about a display state of the display panel 210 (for example, an image obtained by capturing the display state of the display panel 210 or data obtained by processing the image), and determine at least one of the plurality of pixels of the display panel 210 as a defective pixel based on the received display state information. The identification module 223 can be configured to obtain information about the pixel determined as the defective pixel as the defective pixel information. The defective pixel information can include at least one of the number of defective pixels, coordinates of the defective pixel, a position of the defective pixel, an identifier of the defective pixel, or a color of the defective pixel. The information about the display state of the display panel 210 can be included as at least a portion of the defective pixel information.

The compensation module 225 can be configured to compensate for a function of the defective pixel based on the obtained defective pixel information by using the other pixels of the plurality of pixels than the defective pixel. By using pixels corresponding to (or having) the same color as the defective pixel among repair pixels located in an adjacent partial region corresponding to the defective pixel among the plurality of pixels of the display panel 210, the compensation module 225 can be configured to provide to the user, visual effects that are the same as or similar to a display state when the defective pixel operates normally. The repair pixel can be a redundancy cell/pixel reserved for compensating for the defective pixel generated in the display panel 210. In an embodiment, the compensation module 225 can be configured to provide to the user, visual effects that are the same as or similar to a display state when the defective pixel operates normally, by using at least one other pixel located in the same partial region or an adjacent partial region corresponding to the defective pixel among the plurality of pixels of the display panel 210, thereby compensating for the function of the defective pixel. In relation to FIGS. 3 through 8, the compensation module 225 will be further described.

The storage module 230 can be, for example, the memory 130 illustrated in FIG. 1 or a register included in a DDI (not shown) for driving the display 150. The storage module 230 can be configured to store the defective pixel information obtained through the identification module 223. The storage module 230 can also provide defective pixel information stored therein to the identification module 223.

The sensor 240 can be included, for example, in the input/output interface 140 illustrated in FIG. 1. The sensor 240 can also be a touch panel (or touch sensor), a pen sensor, or an ultrasonic sensor. In an embodiment, the sensor 240 can be configured to provide coordinates and a color of a defective pixel as at least a portion of defective pixel information to the identification module 223 to indicate the defective pixel if at least one of the plurality of pixels of the display panel 210 is sensed as the defective pixel.

The sensor 240 can be a camera module mounted in the electronic device 200 or a camera module (not shown) included in another device (for example, the electronic device 102 or 104) communication-connected with the electronic device 200. The sensor 240 can be configured to generate information about a display state of the display panel 210 (for example, captures an image or processes a captured image) to provide the display state information to the identification module 223.

In an embodiment, the display panel 210 can be driven by a plurality of control signals corresponding to a plurality of pixels, respectively, and the identification module 223 can be configured to identify at least one of the plurality of pixels as a defective pixel and the compensation module 225 can be configured to compensate for the function of the defective pixel by using at least one pixel from a first pixel group located in a first partial region corresponding to the defective pixel or a second pixel group located in a second partial region that is adjacent to the first partial region among a plurality of partial regions including adjacent pixels of the plurality of pixels.

The identification module 223 can be configured to receive at least one of coordinates, position, identifier, or color of the defective pixel.

The identification module 223 can be configured to sense the position of the defective pixel through the sensor 240 functionally connected with the display panel 210.

In an embodiment, each of the plurality of pixels can correspond to one of a plurality of colors including red, green, blue, or white.

In an embodiment, each of the plurality of partial regions can include a plurality of pixels expressing the same color selected from colors including at least one of red, green, blue, or white.

The electronic device 200 can further include the storage module 230 can be configured to store the information about the defective pixel of the display panel 210, and the identification module 223 can be configured to receive the defective pixel information from the storage module 230.

The identification module 223 can be configured to sense the position of the defective pixel through the sensor 240 that is functionally connected with the electronic device 100.

In an embodiment, the compensation module 225 can be configured to compensate for the function of the defective pixel by using a pixel corresponding to the same color as the defective pixel among pixels of the second pixel group located in the second partial region.

The compensation module 225 can be configured to turn off pixels located in the first partial region and select at least one white pixel among the pixels located in the second partial region as the at least one pixel.

The compensation module 225 can be configured to generate visual effects corresponding to the defective pixel by using the operation of turning off the defective pixel and the at least one pixel.

The compensation module 225 can also be configured to control at least one of a second control signal corresponding to at least one pixel of the first pixel group or a third control signal corresponding to the second pixel group, based on a first control signal corresponding to the defective pixel.

In an embodiment, the compensation module 225 can be configured to compensate for the function of the defective pixel by using a pixel having the same color as the defective pixel among the pixels of the second pixel group located in the second partial region.

In an embodiment, the compensation module 225 can be configured to designate, as the first pixel group, one or more pixel corresponding to the same color as the defective pixel among the pixels located in the second partial region.

The plurality of partial regions can further include a third partial region that is adjacent to the first partial region and is different from the second partial region, and if the color of the defective pixel is a first color, the compensation module 225 can be configured to compensate for the function of the defective pixel, through an operation of turning off a pixel corresponding to a second color among the pixels located in the first partial region, an operation of forming an arrangement including a pixel corresponding to a third color located in the first partial region, and pixels corresponding to the first color, the second color, and the third color located in the third partial region, and an operation of compensating for the function of the defective pixel using the formed arrangement.

The plurality of partial regions can further include the third partial region that is adjacent to the first partial region and is different from the second partial region, and the compensation module 225 can be configured to compensate for the defective pixel, through an operation of turning off the pixels located in the first partial region, an operation of forming an arrangement including a white pixel located in the second partial region and red, green and blue pixels located in the third partial region, and an operation of compensate for the defective pixel using the formed arrangement.

A display device can be configured such that each of the partial regions is formed by arrangement of the some adjacent pixels in a structure of at least one of a rhombic type, a bar type, a triangular type, an L6W type, an RGB stripe type, a square type, a rectangular type, a pentagonal type, or a hexagonal type.

Figure 3:
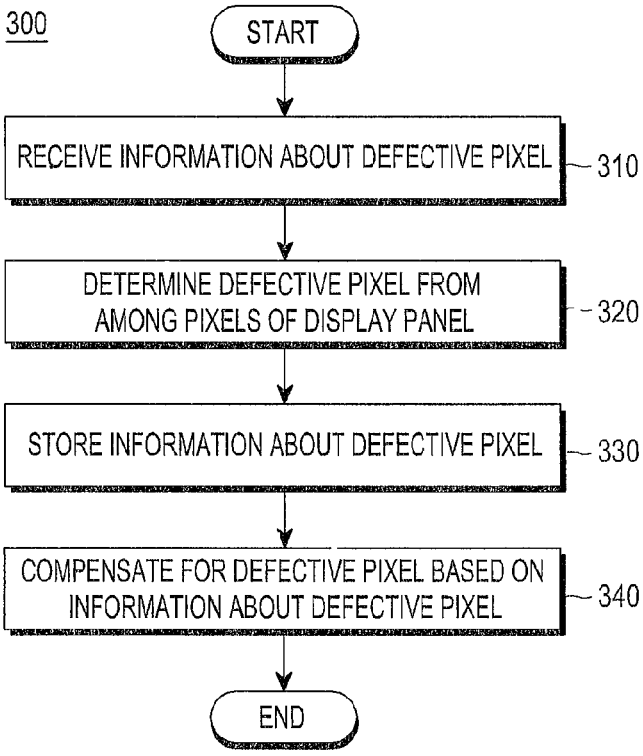
FIG. 3 is a flowchart illustrating a method for compensating for a defective pixel according to various embodiments of the present disclosure.

FIG. 3 is an example flowchart illustrating a method for compensating for a defective pixel according to the present disclosure. Referring to FIG. 3, a defective pixel compensation method 300 includes steps 310 through 340. In step 310, an identification module (for example, the identification module 223) can receive information about a defective pixel through, for example, an external electronic device (for example, the electronic device 102 or 104), an internal component of an electronic device (for example, the processor 120, the memory 130, the input/output interface 140, or the communication module 160), or the sensor (for example, the sensor 240). The defective pixel information can include information (for example, coordinates, position, identifier, or color) indicating at least one of a plurality of pixels of a display panel (for example, the display panel 210). The defective pixel information can include information (for example, a captured image or data obtained by processing the captured image) about a display state of a display panel (for example, the display panel 210).

The display state information can include, for example, information about a color (for example, red, green, blue, or white) of each pixel included in the display panel (for example, the display panel 210). Additionally or alternatively, the display state information can include information about a mixed color (for example, cyan, magenta, yellow, or white) generated by a mixture of colors of the pixels of the display panel (for example, the display panel 210).

In step 320, the identification module (for example, the identification module 223) can determine at least one of the plurality of pixels of the display panel as the defective pixel, based on the defective pixel information received in step 310. In an embodiment, if at least a portion of the received defective pixel information is information directly indicating a particular pixel, for example, information such as position, coordinates, or color of each defective pixel, the particular pixel indicated by the defective pixel information can be determined as the defective pixel. In an embodiment, if at least a portion of the defective pixel information is image information obtained by capturing the display state of the display panel (for example, the display panel 210), at least one of captured pixels can be determined as the defective pixel by using an image analysis algorithm. Moreover, based on the determined defective pixel, information (number, coordinates, position, identifier, or color) about the defective pixel can be generated.

In an embodiment, the image analysis method can compare a plurality of images including information about a color (for example, red, green, blue, or white) of each pixel included in the display panel (for example, the display panel 210). In an embodiment, the image analysis method can compare a plurality of images including information about a color (for example, cyan, magenta, yellow, or white) generated by a mixture of colors of the respective pixels included in the display panel (for example, the display panel 210). The plurality of images used in the image analysis method can be images obtained by capturing the display state corresponding to the same display control signal of the same display panel at a plurality of different capturing points in time.

In step 330, a storage module (for example, the storage module 230) can be configured to store the defective pixel information.

In step 340, the compensation module (for example, the compensation module 225) can compensate for the function of the defective pixel by using at least one other pixel among the plurality of pixels of the display panel (for example, the display panel 210), based on the defective pixel information. The defective pixel information can be at least one of the information received in step 310, the information generated in step 320, and the information stored in step 330. The pixel used for defective pixel compensation can be, for example, a pixel having the same color as the defective pixel among repair pixels located in an adjacent partial region corresponding to the defective pixel or a pixel located in the same partial region or an adjacent partial region corresponding to the defective pixel. With reference to FIGS. 4 through 8, step 330 will be additionally described.

Figure 4:
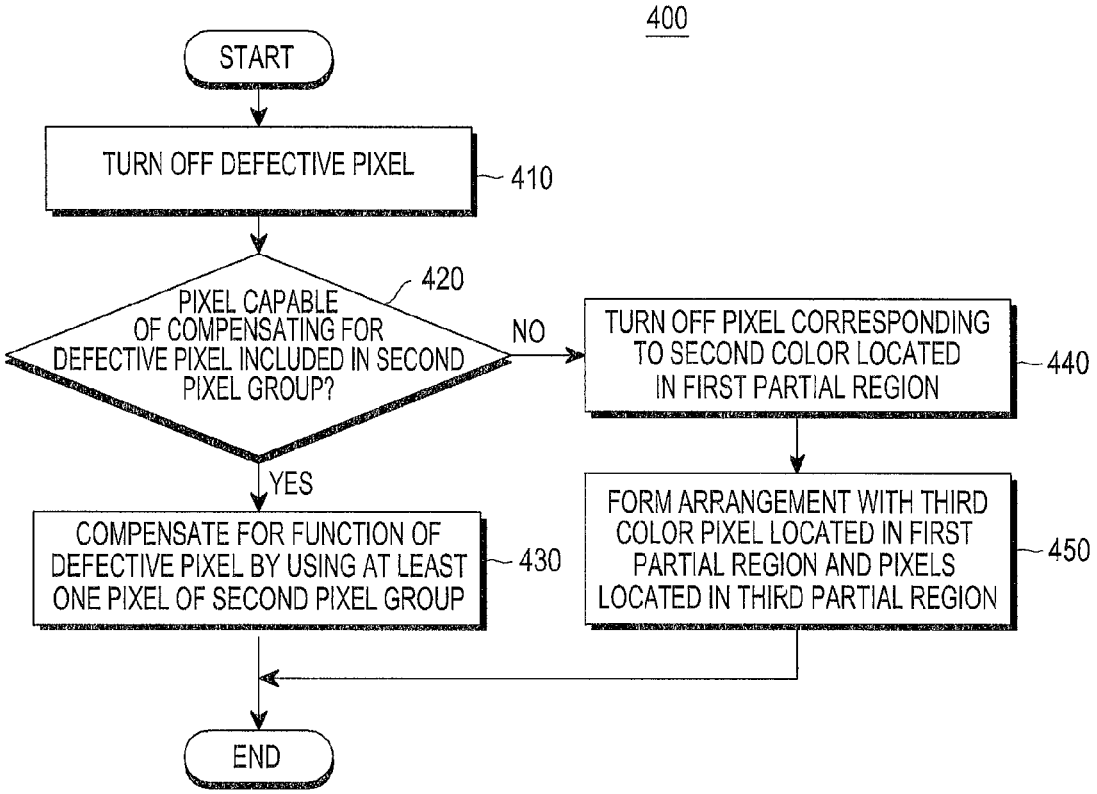
FIG. 4 is an example flowchart illustrating a method for compensating for a defective pixel according to the present disclosure.

FIG. 4 is an example flowchart illustrating a defective pixel compensation method according to the present disclosure. Referring to FIG. 4, a defective pixel compensation method 400 can include steps 410 through 450. In step 410, the compensation module (for example, the compensation module 225) can turn off at least one defective pixel among a plurality of pixels of the display panel (for example, the display panel 210).

According to the present disclosure, in steps 420 through 440, the compensation module (for example, the compensation module 225) can create visual effects corresponding to at least one defective pixel among the plurality of pixels of the display panel (for example, the display panel 210).

According to the present disclosure, in step 420, the compensation module (for example, the compensation module 225) can determine whether a pixel capable of compensating for the defective pixel (for example, a repair pixel) is included in a second pixel group.

According to the present disclosure, in step 430, if the compensating pixel (for example, the repair pixel) is included in the second pixel group, the compensation module (for example, the compensation module 225) can compensate for the function of the defective pixel by using at least one pixel (for example, the repair pixel) included in the second pixel group. For example, by using a pixel corresponding to a color that is the same as or different from the defective pixel, visual effects that are the same as or similar to those obtained when the defective pixel operates normally can be provided to the user. With reference to FIGS. 5 through 8, steps 420 and 430 will be described further.

In an embodiment, in step 440, the compensation module (for example, the compensation module 225) can turn off a second color pixel (for example, a red pixel or a blue pixel) among pixels located in a partial region in which the defective pixel is included, if the pixel (for example, the repair pixel) capable of compensating for the function of the defective pixel is not included in the second pixel group that is adjacent to the defective pixel.

In an embodiment, in step 450, the compensation module (for example, the compensation module 225) can select a third color pixel (for example, a green pixel) as the pixel capable of compensating for the function of the defective pixel among pixels located in the other partial region than the defective pixel in a pixel group region including the defective pixel. The compensation module (for example, the compensation module 225) can be configured to compensate for the function of the defective pixel by forming an arrangement which includes pixels included in any of the other pixel groups than the repair pixel group adjacent to the defective pixel and the third color pixel (for example, the green pixel). Steps 440 and 450 will be described further in relation to FIGS. 5 through 8.

Figure 5A:
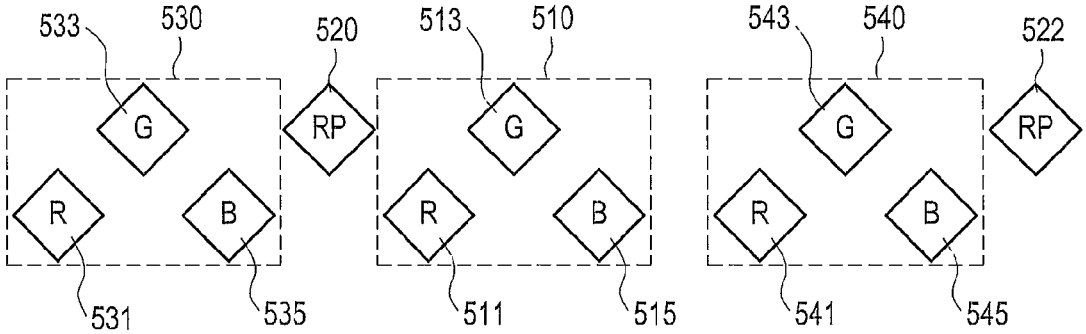
FIGS. 5A and 5B are example illustrations in which a plurality of pixels of a display are arranged in various forms according to the present disclosure.
Figure 5B:
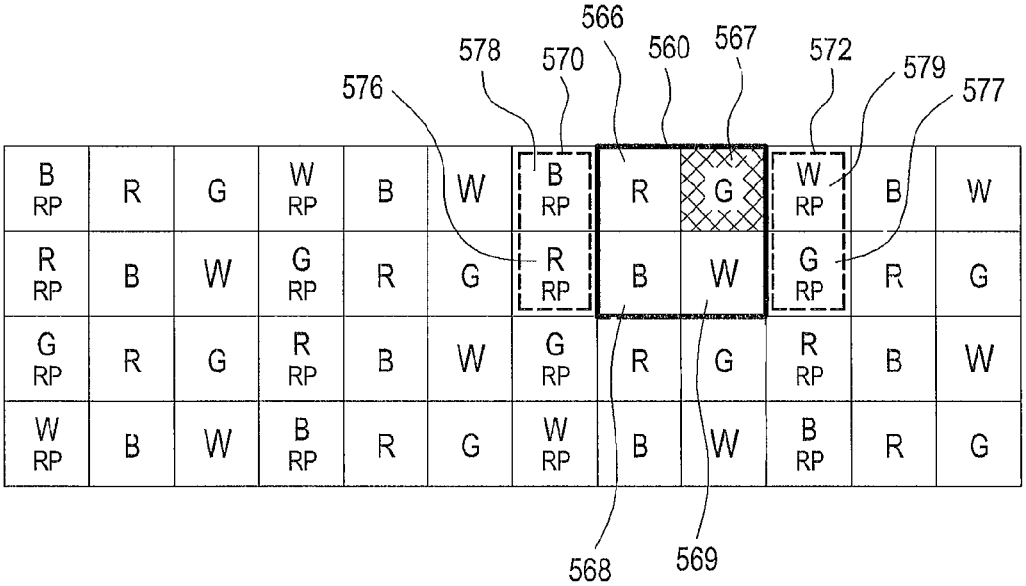

FIGS. 5A and 5B illustrate examples where a plurality of pixels of a display are arranged in various forms according to the present disclosure. FIG. 5A illustrates an example where a plurality of pixels in a rhombic shape of a display are arranged.

A first partial region 510, a second partial region 530, and a third partial region 540 illustrated in FIG. 5A can include a first pixel group (for example, RGB-type sub-pixels), respectively, and can have a rectangular shape.

The first partial region 510 can include three pixels 511, 513, and 515 in a rhombic shape, and the pixels 511, 513, and 515 in the rhombic shape can be disposed in left lower portion, a central upper portion, and a right lower portion of the first partial region 510, respectively. The pixels 511, 513, and 515 in the rhombic shape can be, for example, a red pixel, a green pixel, and a blue pixel, respectively. The pixels 511, 513, and 515 can be arranged such that when center points of the respective pixels 511, 513, and 515 in the rhombic shape are connected by virtual lines in such a way to avoid intersection of the lines, a triangular shape can be formed.

In an embodiment, the second partial region 530 can include three pixels 531, 533, and 535 in a rhombic shape, and the pixels 531, 533, and 535 in the rhombic shape can correspond to the pixels 511, 513, and 515 of the first partial region 510 and can be disposed to have the same composition (for example, a triangular composition) and the same colors (for example, red, green, and blue) as the pixels 511, 513, and 515 of the first partial region 510. Referring to FIG. 5A, a first repair pixel 520 can be disposed to the left of the first partial region 510 and in adjacent to the first partial region 510. At the same time, the first repair pixel 520 can be disposed to the right of the second partial region 530 and in adjacent to the second partial region 530.

The pixels 511, 513, and 515 can be arranged such that when center points of the respective pixels 511, 513, and 515 in the rhombic shape located in the first partial region 510 and a center point of the first repair pixel 520, which is a repair pixel adjacent to the first partial region 510, are connected by virtual lines in such a way to avoid intersection of the lines, a tetragonal shape can be formed. Likewise, the pixels 531, 533, and 535 can be arranged such that when center points of the respective pixels 531, 533, and 535 in the rhombic shape located in the second partial region 530 and the center point of the first repair pixel 520, which is the repair pixel adjacent to the second partial region 530, are connected by virtual lines in such a way to avoid intersection of the lines, a tetragonal shape can be formed.

In an embodiment, a second repair pixel 522 can be located to the right of the third partial region 540 and in adjacent to the third partial region 540.

Like the first partial region 510 or the second partial region 530, the third partial region 540 can include, for example, three pixels 541, 543, and 545 in a rhombic shape, and the pixels 541, 543, and 545 in the rhombic shape can correspond to the pixels 511, 513, and 515 of the first partial region 510 and can be disposed to have the same composition (for example, a triangular composition) and the same colors (for example, red, green, and blue) as the pixels 511, 513, and 515 of the first partial region 510. The pixels 541, 543, and 545 can be arranged such that when center points of the respective pixels 541, 543, and 545 in the rhombic shape located in the third partial region 540 and a center point of the second repair pixel 522, which is a repair pixel adjacent to the third partial region 540, are connected by virtual lines in such a way to avoid intersection of the lines, a tetragonal shape can be formed.

In an embodiment, the color of the repair pixels 520 and 522 of the display panel can be green, and if the green pixel 513 of the first partial region 510 is determined as the defective pixel, the electronic device or the component thereof (for example, the compensation module 225) can compensate for the function of the green pixel 513 which is the defective pixel, by using the first repair pixel 520 that is in adjacent to the first partial region 510 and has the same color as the defective pixel. The electronic device (for example, the compensation module 225) can turn off the green pixel 513 which is the defective pixel. At the same time, the electronic device or the component thereof (for example, the compensation module 225) can turn on the first repair pixel 520 and controls the first repair pixel 520 to produce visual effects that are the same as or similar to those obtained when the green pixel 513 operates normally.

If the red pixel 511 of the first partial region 510 is determined as the defective pixel, the electronic device or the component thereof (for example, the compensation module 225) can turn off the red pixel 511 determined as the defective pixel and at the same time, turn off a second color pixel (for example, the blue pixel 515) having a color that is different from that of the defective pixel among the three pixels 511, 513, and 515 of the first partial region 510. The third color pixel (for example, the green pixel 513) that is not turned off among the three pixels 511, 513, and 515 of the first partial region 510 can be controlled to operate, together with the pixels 531, 533, and 535 of the second partial region 530 or the pixels 541, 543, and 545 of the third partial region 540 that is adjacent to the first partial region 510, as one pixel group (for example, a red-green-blue-green (RGBG) pentile structure), thereby producing visual effects that are the same as or similar to those obtained when the three pixels 511, 513, and 515 of the first partial region 510 operate normally. Also if the blue pixel 515 of the first partial region 510 is determined as the defective pixel, the function of the defective pixel can be compensated for in a manner similar to the foregoing embodiment.

According to an embodiment, if the repair pixels 520 and 522 of the display panel are in white and the green pixel 513 among the three pixels 511, 513, and 515 of the first partial region 510 is determined as the defective pixel, the electronic device or the component thereof (for example, the compensation module 225) can turn off the green pixel 513 determined as the defective pixel and at the same time, can turn off the other pixels (for example, the red pixel 511 and the blue pixel 515) of the first partial region 510 including the defective pixel. The repair pixel 520 that is adjacent to the first partial region 510 can be controlled to operate, together with the pixels (for example, the red pixel 531, the green pixel 533, and the blue pixel 535) of the second partial region 530 that is adjacent to the repair pixel 520 and does not include any defective pixel unlike the first partial region 510, as one pixel group (for example, a red-green-blue-white (RGBW) pentile structure), thereby creating visual effects that are the same as or similar to those obtained when the three pixels 511, 513, and 515 of the first partial region 510 operate normally. Also, if the pixel (for example, the red pixel 511 or the blue pixel 515) of another color (for example, red or blue) of the first partial region 510 is determined as the defective pixel, the function of the defective pixel can be compensated for in a manner similar to the foregoing embodiment.

FIG. 5B illustrates an example where the plurality of pixels of the display are arranged in an RGBW pentile structure (for example, an L6W type) according to this disclosure. Referring to FIG. 5B, a fourth partial region 560 can include a plurality of pixels 566 to 569 arranged in a rectangular shape. In the example illustrated in FIG. 5B, each of the pixels 566 to 569 of the fourth partial region 560 can be in a rectangular shape, but this shape is merely an embodiment and each of the pixels 566 to 569 can be in a circular or ovoid shape. Other embodiments can also be possible.

In an embodiment, at least one of height or width of a rectangular-shape pixel of the fourth partial region 560 can be equal to or less than about a half of at least one of height or width of the fourth partial region 560.

In an embodiment, a diameter of a circular-shape pixel of the fourth partial region 560 can be equal to or less than about a half of at least one of the height or width of the fourth partial region 560.

In an embodiment, at least one of a major-axis diameter or a minor-axis diameter of an ovoid-shape pixel of the fourth partial region 560 can be equal to or less than about a half of at least one of the height or width of the fourth partial region 560.

In an embodiment, the color of the pixel 566 located in a left upper portion of the fourth partial region 560 can be, for example, red. The color of the pixel 567 located in a right upper portion of the fourth partial region 560 can be, for example, green. The color of the pixel 568 located in a left lower portion of the fourth partial region 560 can be, for example, blue. The color of the pixel 569 located in a right lower portion of the fourth partial region 560 can be, for example, white.

The pixels 566 to 569 can be arranged such that when center points of the pixels 566 to 569 included in the fourth partial region 560 are connected by virtual lines in such a way to avoid intersection of the lines, a tetragonal shape can be formed.

Referring to FIG. 5B, a fifth partial region 570 can include a plurality of repair pixels 576 and 578 arranged, for example, in a rectangular shape. In the example illustrated in FIG. 5B, each of the repair pixels 576 and 578 of the fifth partial region 570 can be in a rectangular shape, this shape is merely an embodiment, and each of the repair pixels 576 and 578 can be in a circular or ovoid shape. Other embodiments are also possible.

The fifth partial region 570 can be located adjacent to the fourth partial region 560 such that the right side of the fifth partial region 570 can come in contact with the left side of the fourth partial region 560.

In an embodiment, the color of the third repair pixel 576 located in a lower portion of the fifth partial region 570 can be, for example, red. The color of the fourth repair pixel 578 located in an upper portion of the fifth partial region 570 can be, for example, blue. The red pixel 576 of the fifth partial region 570 can be located adjacent to the blue pixel 568 of the fourth partial region 560 in such a way to contact, for example, the blue pixel 568 of the fourth partial region 560. The blue pixel 578 of the fifth partial region 570 can be located in adjacent to the red pixel 566 of the fourth partial region 560 in such a way to contact, for example, the red pixel 566 of the fourth partial region 560.

The color of a fifth repair pixel 577 located in a lower portion of a sixth partial region 572 can be, for example, green. The color of a sixth repair pixel 579 located in an upper portion of the sixth partial region 572 can be, for example, white. The green pixel 577 of the sixth partial region 572 can be located in adjacent to the white pixel 569 of the fourth partial region 560 in such a way to contact the white pixel 569 of the fourth partial region 560. The white pixel 579 of the fifth partial region 570 can be located in adjacent to the green pixel 567 of the fourth partial region 560 in such a way to contact the green pixel 567 of the fourth partial region 560.

In an embodiment, if the green pixel 567 of the fourth partial region 560 is determined as the defective pixel, the electronic device or the component thereof (for example, the compensation module 225) can compensate for the function of the green pixel 567, which is the defective pixel, by using the fifth repair pixel 577 that is adjacent to the fourth partial region 560 and has the same color as the defective pixel. The electronic device (for example, the compensation module 225) can turn off the green pixel 567 that is the defective pixel. At the same time, the electronic device or the component thereof (for example, the compensation module 225) can turn on the fifth repair pixel 577 and controls the fifth repair pixel 577 to produce visual effects that are the same as or similar to those obtained when the green pixel 513 operates normally. If at least one of the red pixel 566, the blue pixel 568, or the white pixel 569 of the fourth partial region 560 is determined as the defective pixel, the function of the defective pixel can be compensated for in a manner that is similar to the foregoing embodiment.

Figure 6:
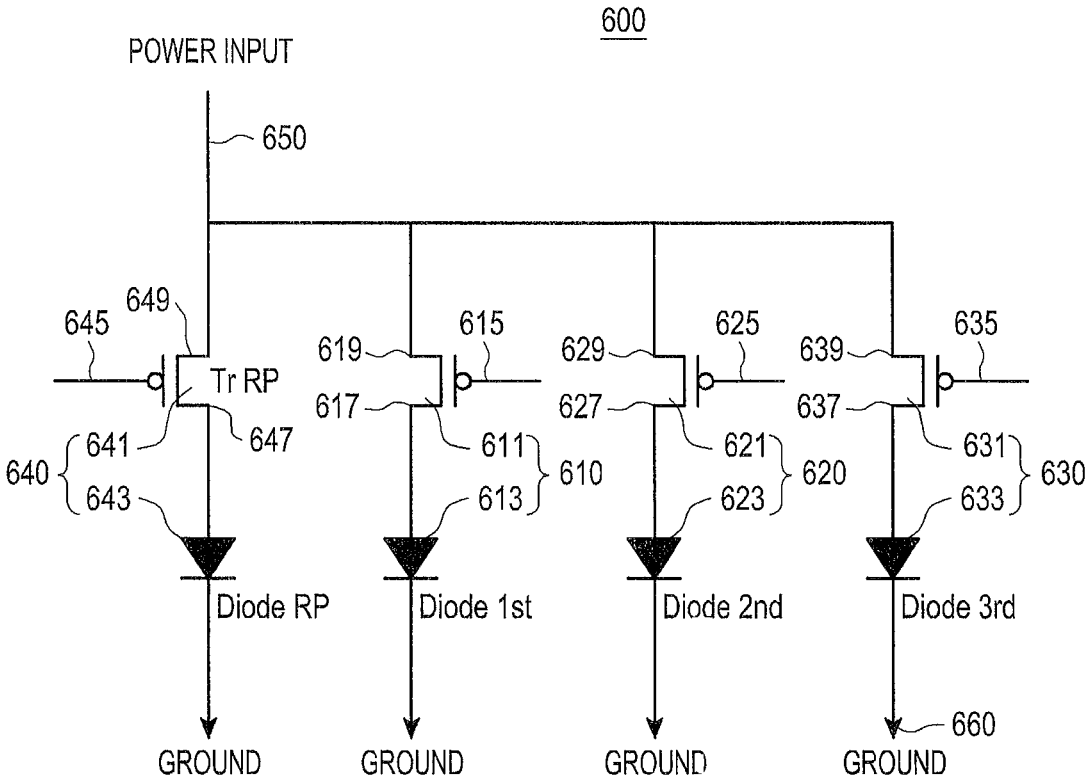
FIG. 6 is an example schematic illustration of a pixel circuit of a display according to the present disclosure.

FIG. 6 is an example schematic illustrating a pixel circuit of a display according to the present disclosure. A pixel circuit 600 can be at least a part of a pixel circuit of, for example, an Active Matrix Organic Light Emitting Diode (AMOLED) panel.

Referring to FIG. 6, the pixel circuit 600 can include a plurality of pixels 610, 620, 630, and 640. In an embodiment, each of the pixels 610, 620, 630, and 640 can include each of LEDs 613, 623, 633, and 643 and each of switches 611, 621, 631, and 641 connected to each LED to control on or off, respectively. Each of the switches 611, 621, 631, and 641 can include each of first terminals 615, 625, 635, and 645, each of second terminals 617, 627, 637, and 647, and each of third terminals 619, 629, 639, and 649, respectively.

In an embodiment, at least one of the switches 611, 621, 631, or 641 can be a p-type Metal Oxide Semiconductor Field Effect Transistor (MOSFET). For example, at least one of the first terminals 615, 625, 635, or 645 can be a gate, at least one of the second terminals 617, 627, 637, or 647 can be a drain, and at least one of the third terminals 619, 629, 639, or 649 can be a source. In an embodiment, at least one of the switches 611, 621, 631, or 641 can be an n-type MOSFET. For example, at least one of the first terminals 615, 625, 635, or 645 can be a gate, at least one of the second terminals 617, 627, 637, or 647 can be a source, and at least one of the third terminals 629, 629, 639, or 649 can be a drain.

A cathode of each of the LEDs 613, 623, 633, and 643 can be grounded. An anode of each of the LEDs 613, 623, 633, and 643 can be connected with each of the second terminals 617, 627, 637, and 647. Each of the third terminals 619, 629, 639, and 649 can be connected to a power input 650. Each of the first terminals 615, 625, 635, and 645 can be coupled to at least one of a processor (for example, the processor 120), a pixel control module (for example, the pixel control module 170), or a display (for example, a DDI included in the display 150). Connection in a pixel circuit can vary with, but not limited by, a type of an LED or a switch of the pixel circuit.

In an embodiment, a plurality of pixels can include normal pixels 610, 620, and 630 forming one pixel group and a repair pixel 640 for compensating for a function of a defective pixel generated in the pixel group. For example, the color of the first normal pixel 610 can be red; the color of the second normal pixel 620 can be green; the color of the third green pixel 630 can be blue, and the color of the repair pixel 640 can be green.

In an embodiment, if the second normal pixel 620 is determined as the defective pixel among the normal pixels 610, 620, and 630, then the electronic device or the component thereof (for example, the compensation module 225) can turn off the switch 621 of the second normal pixel 620. The electronic device or the component thereof (for example, the compensation module 225) can control the power input 650 applied to the anode of the LED 623 of the second normal pixel 620 through a control signal (for example, a high or low signal) of the first terminal 625 of the second normal pixel 620. The electronic device or the component thereof (for example, the compensation module 225) can turn off the switch 621 and maintains the LED 623 in the off state, through the first terminal 625 of the second normal pixel 620.

In an embodiment, if the repair pixel 640 adjacent to the pixel group and the defective pixel included in the pixel group (for example, the second normal pixel 620) have the same color, the electronic device or the component thereof (for example, the compensation module 225) can compensate for the function of the defective pixel (for example, the second normal pixel 620) by using the repair pixel 640.

The electronic device or the component thereof (for example, the compensation module 225) can be configured to group, for example, the other pixels 610 and 630 of the pixel group and the repair pixel 640 to control the pixels 610, 630, and 640 to operate as one pixel group. The electronic device or the component thereof (for example, the compensation module 225) can be configured to turn off, for example, the defective pixel (for example, the second pixel 620). The electronic device or the component thereof (for example, the compensation module 225 can be configured to assign (for example, map or couple) a control signal of the first terminal 625 of the defective pixel (for example, the second pixel 620) to a control signal of the first terminal 645 of the repair pixel 640. The electronic device or the component thereof (for example, the compensation module 225) can be configured to drive control signals of the first terminals 615 and 635 of the switches 611 and 631 of the other pixels 610 and 630 of the pixel group and the control signal of the first terminal 645 of the repair pixel 640 to operate as control signals of one pixel group.

The current embodiment can be applied to a Thin Film Transistor (TFT) LCD and various display devices as well as an AMOLED on a similar principle to the above-described principle.

FIGS. 7A through 7F are examples illustrating pixel arrangement structures of a display according to the present disclosure. The pixel arrangement structures according to the embodiments can be implemented on various types of display panels, such as an OLED, a TFT LCD, or the like.

Figure 7A:
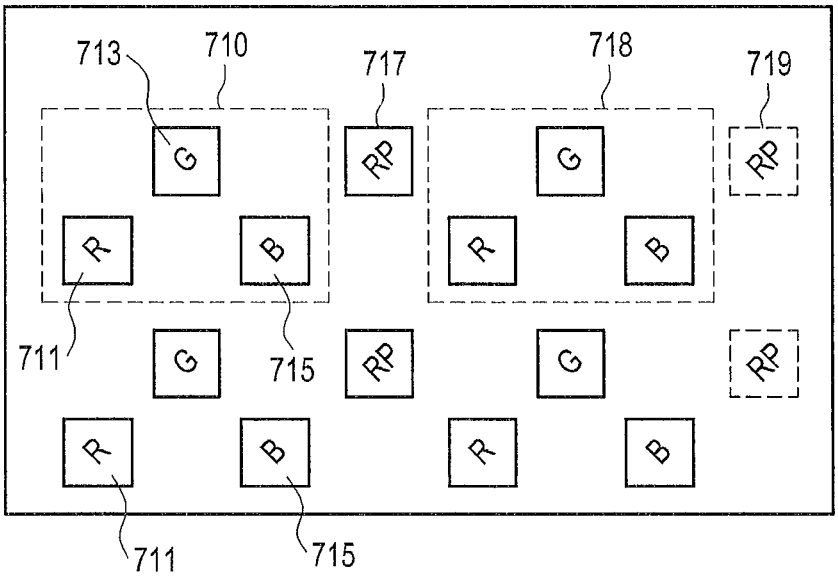
FIGS. 7A to 7F are example illustrations of arrangement structures of a display according to the present disclosure.

FIG. 7A is an example illustration of a square-structure pixel arrangement according to the present disclosure. Referring to FIG. 7A, pixel arrangement can include a first partial region 710 and a second partial region 718. Each of the first partial region 710 and the second partial region 718 can include, for example, a first pixel group (for example, RGB-type sub-pixels).

The first partial region 710 can include a first normal pixel 711, a second normal pixel 713, and a third normal pixel 715. The first to third normal pixels 711, 713, and 715 can be, for example, in a square shape. The first normal pixel 711 can be located in, for example, a left lower portion of the first partial region 710. The second normal pixel 713 can be located in, for example, a center upper portion of the first partial region 710. The third normal pixel 715 can be located in, for example, a right lower portion of the first partial region 710. The first normal pixel 711, the second normal pixel 713, and the third normal pixel 715 can be in red, green, and blue, respectively. The first normal pixel 711, the second normal pixel 713, and the third normal pixel 715 can be arranged such that when center points of the respective pixels 711, 713, and 715 are connected by virtual lines, a triangular shape can be formed.

In an embodiment, a first repair pixel 717 can be located between the first partial region 710 and the second partial region 718 and adjacent to both of them. A second repair pixel 719 can be located adjacent to the right of the second partial region 718. The first repair pixel 717 and the second repair pixel 719 can be, for example, in a square shape like the first to third normal pixels. The second repair pixel 719 can be included in or excluded from the display panel, depending on the structure or manufacturing process of the display panel. The square-structure pixel arrangement can be formed similarly with the rhombic-structure pixel arrangement example illustrated in FIG. 5A.

In an embodiment, if it is recognized (or identified) that the defective pixel is located in at least one of the first partial region 710 or the second partial region 718, the first repair pixel 717 can be controlled to compensate for the function of the identified defective pixel. For example, if the defective pixel is located in the second partial region 718, the second repair pixel 719 can be controlled to compensate for the function of the identified defective pixel.

Figure 7B:
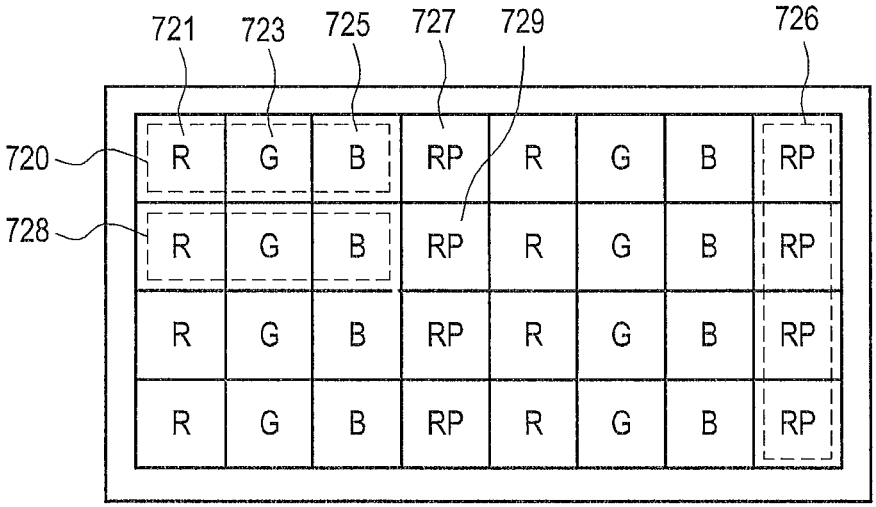

FIG. 7B is an example illustration of an RGB stripe-pattern structure pixel arrangement according to the present disclosure.

Referring to FIG. 7B, the pixel arrangement can include a first partial region 720 and a second partial region 728. Each of the first partial region 720 and the second partial region 728 can include, for example, a first pixel group (for example, RGB-type sub-pixels). Each of the first partial region 720 and the second partial region 728 can be in a rectangular shape whose width is longer than its height. The second partial region 728 can be located adjacent to and in parallel with the first partial region 720 under the first partial region 720. Each partial region can also be located adjacent to and in parallel with another partial region under or above the another partial region, like the arrangement of the first partial region 720 and the second partial region 728.

The first partial region 720 can include, for example, a first normal pixel 721, a second normal pixel 723, and a third normal pixel 725. The first normal pixel 721 can be located in a left portion of the first partial region 720. The second normal pixel 723 can be located in the center of the first partial region 720. The third normal pixel 725 can be located in a right portion of the first partial region 720. The first normal pixel 721, the second normal pixel 723, and the third normal pixel 725 can have colors of red, green, and blue, respectively. The first normal pixel 721, the second normal pixel 723, and the third normal pixel 725 can be located such that when center points thereof are connected by virtual lines, one horizontal straight line can be formed.

In an embodiment, each of the second partial region 728 and the other partial regions can include a pixel group (for example, an RGB-arrangement structure) in the same structure as the first partial region 720. Thus, normal pixels in the same color can be vertically arranged in parallel with each other, thus forming a vertical stripe-pattern structure.

A first repair pixel 727 can be located adjacent to the right of the first partial region 720. A second repair pixel 729 can be located adjacent to the right of the second partial region 728. Each repair pixel can also be located adjacent to the right or left of a corresponding adjacent partial region, like the first repair pixel 727 and the second repair pixel 729. Thus, the repair pixels including the first repair pixel 727 and the second repair pixel 729 can be arranged in parallel with one another in the vertical direction, thus forming a vertical stripe-pattern structure like the normal pixels.

Repair pixels 726 located in a right portion of pixel arrangement according to the current embodiment can be included in or excluded from a display panel, depending on the structure or manufacturing process of the display panel.

In an embodiment, if it is recognized (or identified) that the defective pixel is located in the first partial region 720, the first repair pixel 727 can be controlled to compensate for the function of the identified defective pixel. If it is recognized (or identified) that the defective pixel is located in the second partial region 728, the second repair pixel 729 can be controlled to compensate for the function of the identified defective pixel.

Figure 7C:
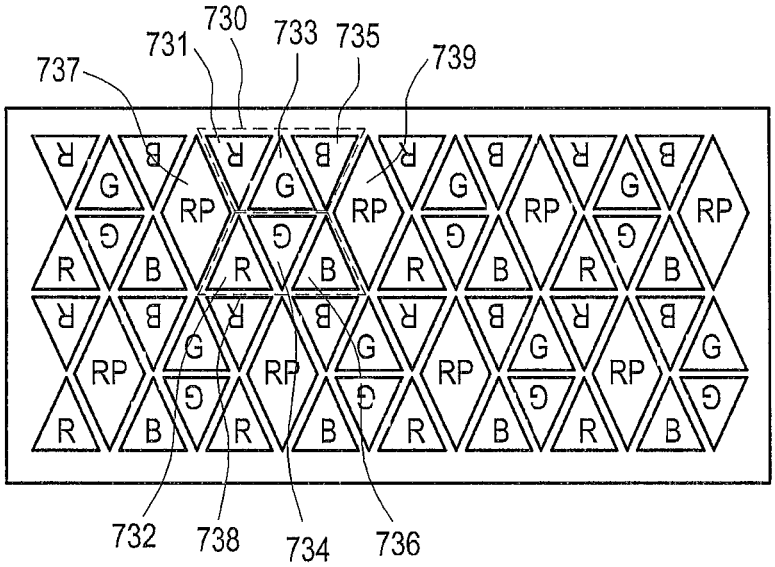

FIG. 7C is an example illustration of a triangular-structure pixel arrangement according to the present disclosure. Referring to FIG. 7C, pixel arrangement can include a first partial region 730 and a second partial region 738. Each of the first partial region 730 and the second partial region 738 can include, for example, a first pixel group (for example, RGB-type sub-pixels). The first partial region 730 can be in, for example, an equilateral trapezoid shape in which between two parallel sides, a top side is longer than a bottom side. The second partial region 738 can be, for example, an equilateral trapezoid shape in which between two parallel sides, a bottom side is longer than a top side. The second partial region 738 can be located adjacent to the first partial region 730 under the first partial region 730 to face the first partial region 720. Thus, the short bottom side of the first partial region 730 can be located adjacent to the short top side of the second partial region 738.

In an embodiment, the first partial region 730 can include a first normal pixel 731, a second normal pixel 733, and a third normal pixel 735. The first normal pixel 731 and the third normal pixel 735 can be, for example, in an inverted triangular shape. The second normal pixel 733 can be, for example, in a triangular shape. The first normal pixel 731 can be located in a left portion of the first partial region 730. The second normal pixel 733 can be located in the center of the first partial region 730. The third normal pixel 735 can be located in a right portion of the first partial region 730. The first normal pixel 731, the second normal pixel 733, and the third normal pixel 735 can have colors of red, green, and blue, respectively.

The second partial region 738 can include a fourth normal pixel 732, a fifth normal pixel 734, and a sixth normal pixel 736. The fourth normal pixel 732 and the sixth normal pixel 736 can be, for example, in a triangular shape. The fifth normal pixel 734 can be, for example, in a triangular shape. The fourth normal pixel 732 can be located in a left portion of the second partial region 738. The fifth normal pixel 734 can be located in the center of the second partial region 738. The sixth normal pixel 736 can be located in a right portion of the second partial region 738. The fourth normal pixel 732, the fifth normal pixel 734, and the sixth normal pixel 736 can have colors of red, green, and blue, respectively.

In an embodiment, a first repair pixel 737 can be located adjacent to the left portions of the first partial region 730 and the second partial region 738. A second repair pixel 739 can be located adjacent to the right portions of the first partial region 730 and the second partial region 738. The first repair pixel 737, the second repair pixel 739, and other repair pixels can be, for example, in a rhombic shape. In an embodiment, depending on display panel pixel designing, the repair pixel in the rhombic shape (for example, the first repair pixel 737, the second repair pixel 739, or other repair pixels) can be divided into a plurality of triangular-shape repair pixels.

In an embodiment, if it is recognized (or identified) that the defective pixel is located in the first partial region 730 or the second partial region 738, at least one of the first repair pixel 737 or the second repair pixel 739 can be controlled to compensate for the function of the identified defective pixel. If it is recognized (or identified) that the defective pixel is located in the first partial region 730 or the second partial region 738, the second repair pixel 739 can be controlled to compensate for the function of the identified defective pixel.

Figure 7D:
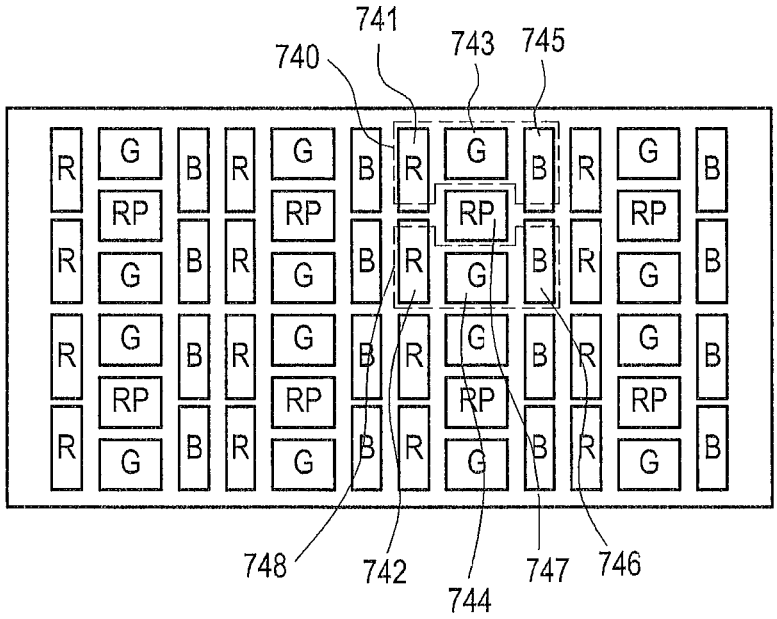

FIG. 7D is an example illustration of a bar-type structure pixel arrangement according to the present disclosure. Referring to FIG. 7D, a pixel arrangement can include a first partial region 740 and a second partial region 748. Each of the first partial region 740 and the second partial region 748 can include, for example, a first pixel group (for example, RGB-type sub-pixels). The second partial region 748 can be located under the first partial region 740.

In an embodiment, the first partial region 740 can include a first normal pixel 741, a second normal pixel 743, and a third normal pixel 745. The first normal pixel 741 and the third normal pixel 745 can be, for example, in a rectangular shape whose height is longer than its width. The second normal pixel 743 can be, for example, in a rectangular shape whose height is shorter than its width. The first normal pixel 741 can be located in a left portion of the first partial region 740. The second normal pixel 743 can be located in the center of the first partial region 740. The third normal pixel 745 can be located in a right portion of the first partial region 740. The first normal pixel 741, the second normal pixel 743, and the third normal pixel 745 can have colors of, for example, red, green, and blue, respectively.

The second partial region 748 can include a fourth normal pixel 742, a fifth normal pixel 744, and a sixth normal pixel 746. The fourth normal pixel 742 and the sixth normal pixel 746 can be, for example, in a rectangular shape whose height is longer than its width. The fifth normal pixel 744 can be, for example, in a rectangular shape whose height is shorter than its width. The fourth normal pixel 742 can be located in a left portion of the first partial region 740. The fifth normal pixel 744 can be located in the center of the first partial region 740. The sixth normal pixel 746 can be located in a right portion of the first partial region 740. The fourth normal pixel 742, the fifth normal pixel 744, and the sixth normal pixel 746 can have colors of red, green, and blue, respectively.

In an embodiment, a repair pixel 747 can be located between the first partial region 740 and the second partial region 748. The repair pixel 747 can be located adjacent to all of the right side of the first normal pixel 741, the bottom side of the second normal pixel 743, and the left side of the third normal pixel 745. The repair pixel 747 can also be located adjacent to all of the right side of the fourth normal pixel 742, the bottom side of the fifth normal pixel 744, and the left side of the sixth normal pixel 746. The repair pixel 747 can be, for example, in a tetragonal shape. In an embodiment, depending on display panel pixel designing, a tetragonal-shape repair pixel (for example, the repair pixel 747 or other repair pixels) can be divided into a plurality of tetragonal-shape repair pixels.

In an embodiment, if it is recognized (or identified) that the defective pixel is located in the first partial region 740 or the second partial region 748, the repair pixel 747 can be controlled to compensate for the function of the identified defective pixel.

Figure 7E:
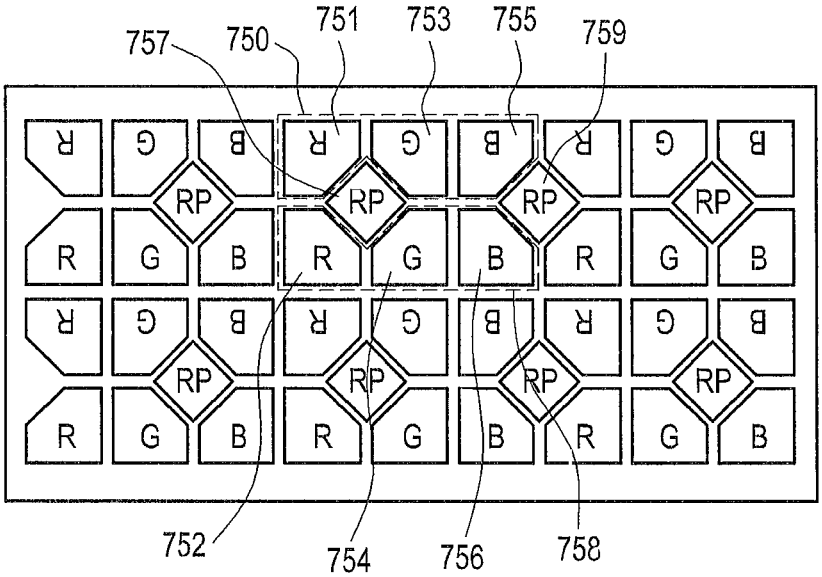

FIG. 7E is an example illustrating pentagon-type structure pixel arrangement according to the present disclosure. Referring to FIG. 7E, the pixel arrangement can include a first partial region 750 and a second partial region 758. Each of the first partial region 750 and the second partial region 758 can include, for example, a first pixel group (for example, RGB-type sub-pixels). The second partial region 758 can be located under the first partial region 750.

In an embodiment, the first partial region 750 can include a first normal pixel 751, a second normal pixel 753, and a third normal pixel 755. The first normal pixel 751 and the third normal pixel 755 can be, for example, in a pentagonal shape formed by linearly cutting a right lower corner of a rectangular shape. The second normal pixel 753 can be, for example, in a pentagonal shape formed by linearly cutting a left lower corner of a rectangular shape. The first normal pixel 751 can be located in a left portion of the first partial region 750. The second normal pixel 753 can be located in the center of the first partial region 750. The third normal pixel 755 can be located in a right portion of the first partial region 750. The first normal pixel 751, the second normal pixel 753, and the third normal pixel 755 can have colors of, for example, red, green, and blue.

The second partial region 758 can include a fourth normal pixel 752, a fifth normal pixel 754, and a sixth normal pixel 756. The fourth normal pixel 752 and the sixth normal pixel 756 can be, for example, in a pentagonal shape formed by linearly cutting a right lower corner of a rectangular shape. The fifth normal pixel 754 can be, for example, in a pentagonal shape formed by linearly cutting a left upper corner of a rectangular shape. The fourth normal pixel 752 can be located in a left portion of the second partial region 758. The fifth normal pixel 754 can be located in the center of the second partial region 758. The sixth normal pixel 756 can be located in a right portion of the second partial region 758. The fourth normal pixel 752, the fifth normal pixel 754, and the sixth normal pixel 756 can have colors of, for example, red, green, and blue.

The first repair pixel 757 can be located between the first partial region 750 and the second partial region 758. The first repair pixel 757 can be located adjacent to the right lower side of the first normal pixel 751 and the left lower side of the second normal pixel 753. The first repair pixel 757 can also be located adjacent to the right upper side of the fourth normal pixel 752 and the left upper side of the fifth normal pixel 754. The first repair pixel 757 can be, for example, in a rhombic shape.

In an embodiment, the second repair pixel 759 can be located adjacent to the right lower side of the first partial region 750 and the right upper side of the second partial region 758. The second repair pixel 759 can be located adjacent to the right lower side of the third normal pixel 755. The second repair pixel 759 can also be located adjacent to the right upper side of the sixth normal pixel 756. The second repair pixel 759 can be, for example, in a rhombic shape like the first repair pixel 757.

In an embodiment, depending on display panel pixel designing, the rhombic-shape repair pixel (for example, the first repair pixel 757, the second repair pixel 759, or other repair pixels) can be divided into a plurality of triangular-shape repair pixels.

If it is recognized (or identified) that the defective pixel is located in the first partial region 750 or the second partial region 758, at least one of the first repair pixel 757 or the second repair pixel 759 can be controlled to compensate for the function of the identified defective pixel.

Figure 7F:
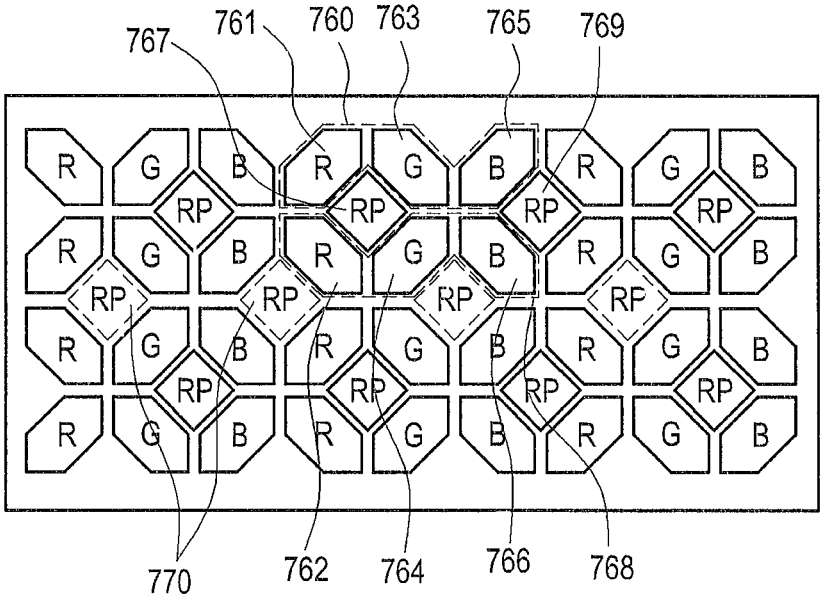

FIG. 7F is an example illustrating a hexagonal-type structure pixel arrangement according to the present disclosure. Referring to FIG. 7F, pixel arrangement can include a first partial region 760 and a second partial region 768. Each of the first partial region 760 and the second partial region 768 can include, for example, a first pixel group (for example, RGB-type sub-pixels). The second partial region 768 can be located under the first partial region 760.

In an embodiment, the first partial region 760 can include a first normal pixel 761, a second normal pixel 763, and a third normal pixel 765. The first normal pixel 761 and the third normal pixel 765 can be, for example, in a hexagonal shape formed by linearly cutting left upper corner and right lower corner of a rectangular shape. The second normal pixel 763 can be, for example, in a hexagonal shape formed by linearly cutting right upper corner and left lower corner of a rectangular shape. The first normal pixel 761 can be located in a left portion of the first partial region 760. The second normal pixel 763 can be located in the center of the first partial region 760. The third normal pixel 765 can be located in a right portion of the first partial region 760. The first normal pixel 761, the second normal pixel 763, and the third normal pixel 765 can have colors of, for example, red, green, and blue.

The second partial region 768 can include a fourth normal pixel 762, a fifth normal pixel 764, and a sixth normal pixel 766. The fourth normal pixel 762 and the sixth normal pixel 766 can be, for example, in a hexagonal shape formed by linearly cutting right upper corner and left lower corner of a rectangular shape. The fifth normal pixel 764 can be, for example, in a hexagonal shape formed by linearly cutting left upper corner and right lower corner of a rectangular shape. The fourth normal pixel 762 can be located in a left portion of the second partial region 768. The fifth normal pixel 764 can be located in the center of the second partial region 768. The sixth normal pixel 766 can be located in a right portion of the second partial region 768. The fourth normal pixel 762, the fifth normal pixel 764, and the sixth normal pixel 766 can have colors of, for example, red, green, and blue.

In an embodiment, the first repair pixel 767 can be located between the first partial region 760 and the second partial region 768. The first repair pixel 767 can be located adjacent to the right lower side of the first normal pixel 761 and the left lower side of the second normal pixel 763. The first repair pixel 767 can be located adjacent to the right upper side of the fourth normal pixel 762 and the left upper side of the fifth normal pixel 764. The first repair pixel 767 can be, for example, in a rhombic shape.

The second repair pixel 769 can be located adjacent to the right lower side of the first partial region 760 and the right upper side of the second partial region 768. The second repair pixel 769 can be located adjacent to the right lower side of the third normal pixel 765. The second repair pixel 769 can be located adjacent to the right upper side of the sixth normal pixel 766. The second repair pixel 769 can be, for example, in a rhombic shape like the first repair pixel 767.

In an embodiment, depending on display panel pixel designing, the rhombic-shape repair pixel (for example, the first repair pixel 767, the second repair pixel 769, or other repair pixels) can be divided into a plurality of triangular-shape repair pixels.

In an embodiment, if it is recognized (or identified) that the defective pixel is located in the first partial region 760 or the second partial region 768, at least one of the first repair pixel 767 or the second repair pixel 769 can be controlled to compensate for the function of the identified defective pixel.

A plurality of repair pixels 770 arranged horizontally in the center of pixel arrangement can be included in or excluded from a display panel, depending on the structure or manufacturing process of the display panel.

In FIGS. 7A through 7F, the shape of each of the plurality of pixels of the display panel, including normal pixels and repair pixels, can be in various shapes, such as a square shape, a rectangular shape, a rhombic shape, a circular shape, a hexagonal shape, or an ovoid shape, and these shapes are merely an embodiment and the pixel according to the current embodiment is not limited to a pixel in a particular shape.

In FIGS. 5A and 5B and FIGS. 7A through 7F, the color of each repair pixel of the display panel can be various, such as red, green, blue, or white, and these colors are merely an embodiment, and the repair pixel according to the current embodiment is not limited to a pixel in a particular color.

Figure 8:
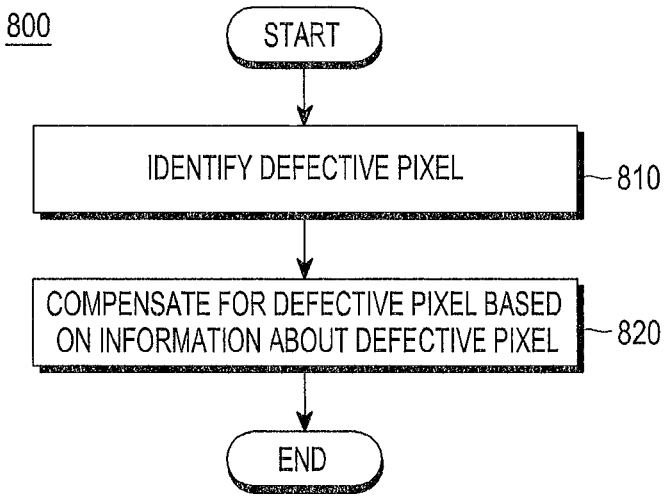
FIG. 8 is an example flowchart illustrating a defective pixel compensation method according to the present disclosure.

FIG. 8 is an example flowchart illustrating a defective pixel compensation method according to the present disclosure.

Referring to FIG. 8, a defective pixel compensation method 800 can include steps 810 and 820. In step 810, the electronic device or the component thereof (for example, the identification module 223) can identify at least one of the plurality of pixels of the display as the defective pixel. To this end, the electronic device or the component (for example, the identification module 223) can obtain information about the defective pixel of the display from an internal component of the electronic device (for example, the storage module 230 or the sensor 240) or an external device (for example, the electronic device 102 or the electronic device 104).

In step 820, the electronic device or the component (for example, the compensation module 225) can compensate for the function of the defective pixel, by using at least one pixel of the first pixel group located in the first partial region corresponding to the defective pixel or the second pixel group located in the second partial region adjacent to the first partial region among a plurality of partial regions, each including some adjacent pixels of the plurality of pixels.

Steps (for example, steps 310 through 340, 410 through 450, or 810 and 820) described in the process or method illustrated in FIG. 3, 4, or 8 can be executed in a sequential, parallel, repetitive, or heuristic manner. In addition, the steps can be executed in a different order, some of them can be omitted, or other steps can be added thereto.

In an embodiment, a method for compensating for a defective pixel can include a step of identifying, as a defective pixel, at least one of a plurality of pixels of a display and a step of compensating a function of the defective pixel using at least one pixel from a first pixel group formed in a first partial region corresponding to the defective pixel, or a second pixel group formed in a second partial region adjacent to the first partial region among a plurality of partial regions.

In an embodiment, the identifying step can include a step of receiving information about at least one of a quantity, coordinates, a position, an identifier, or a color of the defective pixel.

In an embodiment, the identifying step can include a step of receiving image information obtained by capturing a display state of the display and a step of identifying information indicating the defective pixel using the image information.

In an embodiment, the defective pixel compensation method can further include a step of storing information about the defective pixel of the display panel, and the identifying step can include a step of receiving the information received through the storing step.

In an embodiment, the identifying step can include a step of sensing a position of the defective pixel via a sensor operatively coupled with the display.

In an embodiment, each of the plurality of pixels can correspond to one of a plurality of colors comprising red, green, blue, or white.

In an embodiment, each of the plurality of pixels can include a plurality of pixels expressing the same color selected from among at least one color comprising red, green, blue, and white.

In an embodiment, the compensating step can include a step of turning off the defective pixel and a step of generating visual effects corresponding to the defective pixel using the at least one pixel.

In an embodiment, the compensating step can include a step of compensating, as the second pixel group, the function of the defective pixel using a pixel corresponding to the same color as the defective pixel among pixels located in the second partial region.

In an embodiment, the compensating step can include a step of designating, as the first pixel group, one or more pixels corresponding to the same color as the defective pixel among pixels located in the second partial region.

In an embodiment, the plurality of partial regions can further include a third partial region that is adjacent to the first partial region and is different from the second partial region, and the compensating step can include turning off a pixel corresponding to a second color among the pixels located in the first partial region, if a color of the defective pixel is a first color, a step of forming an arrangement comprising a pixel corresponding to a third color located in the first partial region, and pixels corresponding to the first color, the second color, and the third color, which are located in the third partial region, and a step of compensating the function of the defective pixel via the arrangement.

In an embodiment, the plurality of partial regions can further include a third partial region that is adjacent to the first partial region and is different from the second partial region, and the compensating step can include a step of turning off the pixels located in the first partial region, a step of forming a arrangement including a white pixel located in the second partial region and red, green, and blue pixels among pixels located in the third partial region, and a step of compensating the function of the defective pixel via the arrangement.

In an embodiment, the compensating step can include a step of controlling at least one of a second control signal corresponding to at least one pixel of the first pixel group and a third control signal corresponding to the second pixel group, based on a first control signal corresponding to the defective pixel.

Figure 9:
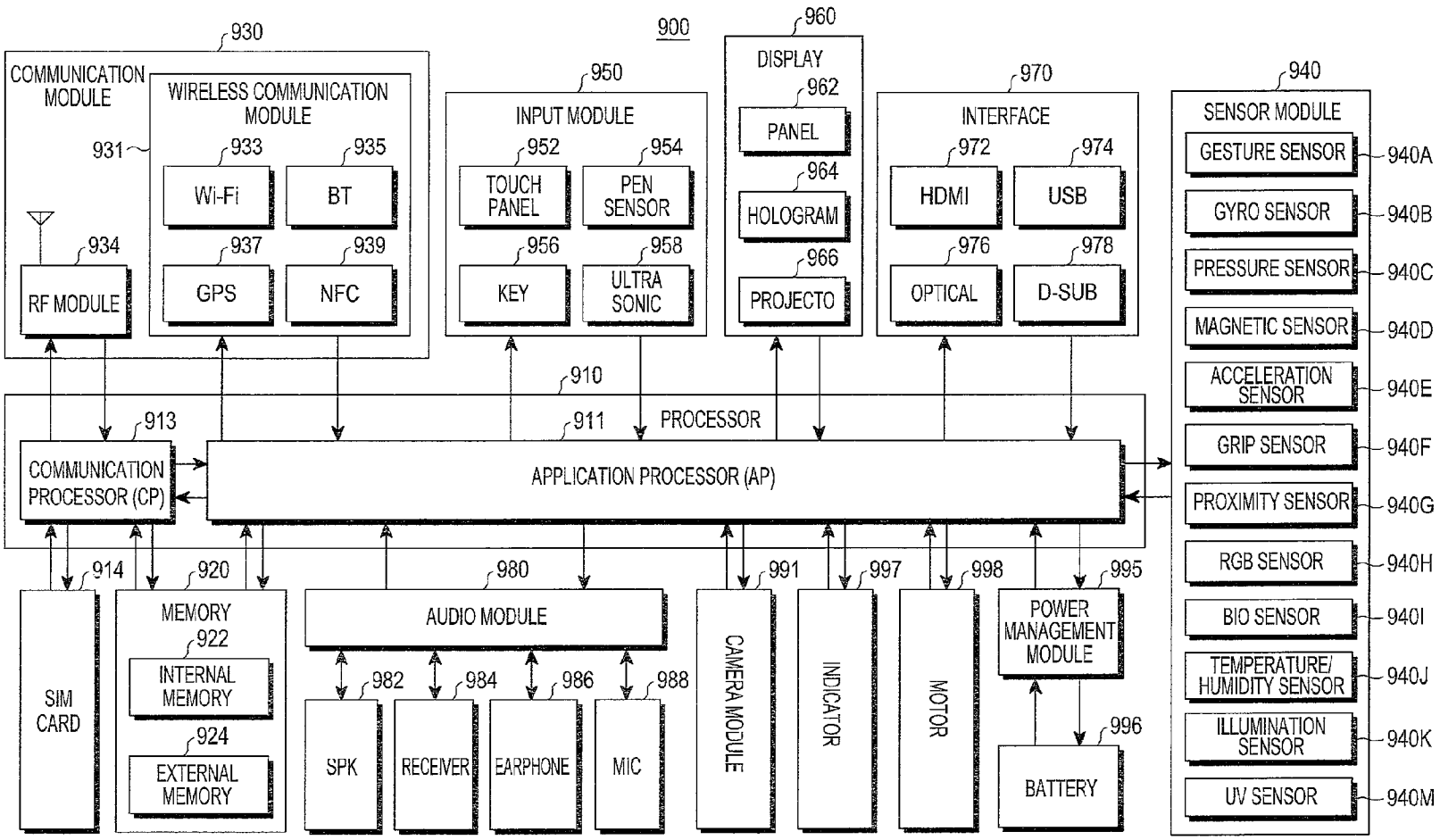
FIG. 9 is an example block diagram illustrating an electronic device according to the present disclosure.

FIG. 9 is an example block diagram illustrating an electronic device 900 according to the present disclosure. The electronic device 900 can form the entire electronic device 100 illustrated in FIG. 1 or a part of the electronic device 100 illustrated in FIG. 1. Referring to FIG. 9, the electronic device 900 can include one or more processors 910, a Subscriber Identification Module (SIM) card 914, a memory 920, a communication module 930, a sensor module 940, an input module 950, a display 960, an interface 970, an audio module 980, a camera module 991, a power management module 995, a battery 996, an indicator 997, or a motor 998.

The processor 910 can include one or more Application Processors (APs) 911 or one or more Communication Processors (CPs) 913. The processor 910 can be, for example, the processor 120 illustrated in FIG. 1. Although the AP 911 and the CP 913 are illustrated as being included in the processor 910 in FIG. 9, the AP 911 and the CP 913 can also be included in different IC packages. According to an embodiment, the AP 911 and the CP 913 can be included in one IC package.

The AP 911 can be configured to control multiple hardware or software components connected to the AP 911 by driving an Operating System (OS) or an application program, and can perform processing and operations with respect to various data including multimedia data. The AP 911 can be implemented with, for example, a System on Chip (SoC). In an embodiment, the processor 910 can further include a Graphic Processing Unit (GPU, not shown).

The CP 913 can be configured to manage a data link and convert a communication protocol in communication between other electronic devices connected with the electronic device 900 through a network. The CP 913 can be implemented with, for example, a SoC. In an embodiment, the CP 913 can perform at least a part of a multimedia control function. The CP 913 can perform identification and authentication of the electronic device 900 in a communication network by using a subscriber identification module (for example, the SIM card 914). The CP 913 can be configured to provide the user with services such as voice communication, video communication, text messages, or packet data.

The CP 913 can be configured to control data transmission and reception of the communication module 930. Although components of the CP 913, the power management module 995, or the memory 920 are shown as a component that is separate from the AP 911 in FIG. 9, the AP 911 can be implemented to include at least some (for example, the CP 913) of the foregoing elements according to an embodiment of the present disclosure.

In an embodiment, the AP 911 or the CP 913 can be configured to load a command or data received from at least one of a non-volatile memory or other elements connected to the AP 911 or the CP 913 into a volatile memory and can be configured to process the command or data. The AP 911 or the CP 913 can be configured to store data received from at least one of other elements or data generated by at least one of the elements in the non-volatile memory.

The SIM card 914 can be a card that implements a subscriber identification module, and can be inserted into a slot formed in a particular position of the electronic device 900. The SIM card 914 can include unique identification information (for example, an Integrated Circuit Card Identifier (ICCID) or subscriber information (for example, an International Mobile Subscriber Identity (IMSI)).

The memory 920 can include an internal memory 922 or an external memory 924. The memory 920 can be the memory 130 illustrated in FIG. 1. The internal memory 922 can include at least one of a volatile memory (for example, Dynamic Random Access Memory (DRAM), Static RAM (SRAM), Synchronous Dynamic RAM (SDRAM), and a non-volatile memory (for example, One Time Programmable Read Only Memory (OTPROM), Programmable ROM (PROM), Erasable and Programmable ROM (EPROM), Electrically Erasable and Programmable ROM (EEPROM), mask ROM, flash ROM, NAND flash memory, or NOR flash memory). In an embodiment, the internal memory 922 can be a Solid State Drive (SSD). The external memory 924 can further include flash drive, for example, Compact Flash (CF), Secure Digital (SD), micro-SD, mini-SD, extreme Digital (xD), or a memory stick. The external memory 924 can be functionally connected with the electronic device 900 through various interfaces.

Although not shown, a storage device (or storage medium) such as a hard drive can be further included in the electronic device 900.

The communication module 930 can include a wireless communication module 931 or an RF module 934. The communication module 930 can be included in the communication module 160 illustrated in FIG. 1. The wireless communication module 931 can include, for example, WiFi 933, Bluetooth (BT) 935, a Global Positioning System (GPS) 937, or Neat' Field Communication (NFC) 939. For example, the wireless communication module 931 can provide a wireless communication function by using radio frequencies. Additionally or alternatively, the wireless communication module 931 can include a network interface (for example, a Local Area Network (LAN) card) or modem to connect the electronic device 900 to a network (for example, Internet, a LAN, a Wide Area Network (WAN), a telecommunication network, a cellular network, a satellite network, or a Plain Old Telephone Service (POTS).

The RF module 934 can be configured to processes transmission and reception of an audio or data signal. Although not shown, a transceiver, a Power Amplifier module (PAM), a frequency filter, or a Low Noise Amplifier (LNA) can be included in the RF module 934. The RF module 934 can further include a part for transmitting and receiving electromagnetic waves on a free space in wireless communication, for example, a conductor or a conducting wire.

The sensor module 940 can include at least one of a gesture sensor 940A, a gyro sensor 940B, a pressure sensor 940C, a magnetic sensor 940D, an acceleration sensor 940E, a grip sensor 940F, a proximity sensor 940G, an RGB sensor 940H, a bio sensor 940I, a temperature/humidity sensor 940J, an illumination sensor 940K, a Ultraviolet (UV) sensor 940M, or an Infrared (IR) sensor (not shown). The sensor module 940 can be configured to measure physical quantity or sense an operation state of the electronic device 900 in order to convert the measurement or sensing information into an electric signal. Additionally or alternately, the sensor module 940 can include, for example, an E-nose sensor (not shown), an Electromyography (EMG) sensor (not shown), an Electroencephalogram (EEG) sensor (not shown), an Electrocardiogram (ECG) sensor (not shown), or a fingerprint sensor. The sensor module 940 can further include a control circuit for controlling at least one sensor included therein.

The input module 950 can include a touch panel 952, a (digital) pen sensor 954, a key 956, or an ultrasonic input device 958. The input module 950 can be included in the input/output interface 140 illustrated in FIG. 1. The touch panel 952 can be configured to recognize a touch input using at least one of a capacitive type, a resistive type, an IR type, or an ultrasonic type. The touch panel 952 can further include a controller (not shown). The capacitive type can be configured to recognize proximity touch as well as physical contact. The touch panel 952 can further include a tactile layer. In this case, the touch panel 952 can be configured to provide tactile reaction to the user.

The (digital) pen sensor 954 can be implemented using a method that is the same as or similar to a method of receiving a touch input from the user or using a separate recognition sheet. The key 956 can include, for example, a physical button. The key 956 can also include an optical key, a keypad, or a touch key. The ultrasonic input device 958 can be a device through which the electronic device 900 senses ultrasonic waves input through a microphone (for example, the microphone 988) using an input means for generating an ultrasonic signal to check data, and the ultrasonic input device 958 can be configured to perform wireless recognition. In an embodiment, the electronic device 900 can be configured to receive a user input from an external device (for example, a network, a computer or a server) connected thereto by using the communication module 930.

The display 960 can include a panel 962, a hologram 964, or a projector 966. The display 960 can be, for example, the display 150 illustrated in FIG. 1. The panel 962 can be, for example, an LCD or AMOLED. The panel 962 can be implemented to be flexible, transparent, or wearable. The panel 962 can be configured with the touch panel 952 in one module. The hologram 964 can be configured to show a stereoscopic image in the air by using interference of light. The projector 966 can display an image onto an external screen through projection of light. In an embodiment, the display 960 can further include a control circuit for controlling the panel 962, the hologram 964, or the projector 966.

The interface 970 can include a High-Definition Multimedia Interface (HDMI) 972, a Universal Serial Bus (USB) 974, an optical communication 976, or a D-subminiature 978. The communication module 930 can be included in the communication module 760 illustrated in FIG. 1. Additionally or alternatively, the interface 970 can include SD/MultiMedia Card (MMC) (not shown) or Infrared Data Association (IrDA) (not shown).

The audio module 980 can be configured to bi-directionally convert sound and an electric signal. The audio module 980 can be included in the input/output interface 140 illustrated in FIG. 1. The audio module 980 can be configured to process sound information input or output through the speaker 982, the receiver 984, the earphone 986, or the microphone 988.

The camera module 991 can be a device configured to capture a still image or a moving image, and can include one or more image sensors (for example, a front sensor or a rear sensor), a lens, an Image Signal Processor (ISP, not shown), or a flash (not shown, for example, an LED or a xenon lamp).

The power management module 995 can be configured to manage power of the electronic device 900. Although not shown, a Power Management Integrated Circuit (PMIC), a charger IC, or a battery fuel gauge can be further included in the power management module 995.

The PMIC can be mounted on an IC or a SoC semiconductor. The charging scheme can be divided into a wired type and a wireless type. The charging IC can be configured to charge a battery and prevent over-voltage or over-current from being introduced from the charger. In an embodiment, the charger IC can include a charger IC for at least one of a wired charging scheme or a wireless charging scheme. The wireless charging scheme can include a magnetic resonance type, a magnetic induction type, or an electromagnetic type, and can further include an additional circuit for wireless charging, for example, a coil loop, a resonance circuit, or a rectifier.

The battery gauge can be configured to measure the remaining capacity of the battery 996 or the voltage, current, or temperature of the battery 996 during charging. The battery 996 can be configured to store electricity and supplies power. The battery 996 can include a rechargeable battery or a solar battery. The indicator 997 can be configured to display a particular state, for example, a booting state, a message state, or a charging state, of the electronic device 900 or a part thereof (for example, the AP 911). The motor 998 can be configured to convert an electric signal into mechanical vibration.

Although not shown, a processing unit (for example, a GPU) for supporting a mobile TV can be included in the electronic device 900. The processing device can be configured to support the mobile TV processes media data according to, a standard such as Digital Multimedia Broadcasting (DMB), Digital Video Broadcasting (DVB), or a media flow.

Each of the foregoing elements of the electronic device according to the present disclosure can include one or more components and a name of the part can vary with a type of the electronic device. The electronic device according to the present disclosure can include at least one of the foregoing elements, and some of the elements can be omitted therefrom or other elements can be further included therein. As some of the elements of the electronic device according to the present disclosure are coupled into one entity, thereby performing the same function as those of the elements that have not been coupled.

The term "module" used in the present disclosure refers to, for example, a unit including a combination of one or two of hardware, software, and firmware. The "module" can be interchangeably used with a term such as a unit, logic, a logical block, a component, or a circuit. The "module" can be a minimum unit of an integrally configured component or a part thereof. The "module" can be a minimum unit that performs one or more functions or a part thereof. The "module" can be mechanically or electronically implemented. For example, the "module" according to various embodiments of the present disclosure can include at least one of Application-Specific Integrated Circuit (ASIC) chips, Field-Programmable Gate Arrays (FPGAs), or programmable-device devices, which are known or are to be developed to perform certain operations.

According to various embodiments, in a non-transitory storage medium having stored instructions thereon, the instructions can allow at least one processor to perform at least one step when executed by the at least one processor, and the at least one step can include a step of identifying, as a defective pixel, at least one of a plurality of pixels of a display and a step of compensating a function of the defective pixel using at least one pixel from a first pixel group formed in a first partial region corresponding to the defective pixel, or a second pixel group formed in a second partial region adjacent to the first partial region among a plurality of partial regions.

The electronic device can be configured to receive and store a program including instructions for allowing the electronic device to perform the defective pixel compensation method from a program providing device wirelessly or wired connected to the electronic device, and the electronic device or the server illustrated in FIG. 1 can be the program providing device. The program providing device can include a memory for storing the program, a communication module for performing wired or wireless communication with the electronic device, and a processor for transmitting the program to the electronic device at the request of the electronic device or automatically.

The method and apparatus for compensating for the defective pixel of the display according to various embodiments of the present disclosure can easily compensate for the function of the defective pixel in various forms generated in the manufacturing process of the display, and improve yield and profit in the manufacturing process of the display. Moreover, the function of the defective pixel generated during the use of the user can be easily compensated for, thus lengthening the lifespans of the display panel and the electronic device including the display panel.

Other effects that can be obtained or expected from the embodiment of the present disclosure are explicitly or implicitly disclosed in the detailed description of the embodiment of the present disclosure. That is, various effects expected from the embodiment of the present disclosure have been disclosed in the detailed description of the present disclosure.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A method comprising:

identifying, as a defective pixel, at least one of a plurality of pixels of a display; and compensating a color of the defective pixel using at least one pixel of a second pixel group adjacent to a first pixel group including the defective pixel from among a plurality of pixel groups of the display, wherein the compensating comprises:

turning off both of a red pixel and a blue pixel in the first pixel group, if the defective pixel is one of the red pixel or the blue pixel, forming an arrangement comprising at least one pixel in the first pixel group, and the at least one pixel in the second pixel group, and operating the arrangement as a pixel group to compensate the color of the defective pixel.

2. The method of claim 1, wherein the identifying comprises:

receiving information about at least one of a quantity, coordinates, a position, an identifier, or a color of the defective pixel.

3. The method of claim 1, wherein the identifying comprises:

receiving image information obtained by capturing a display state of the display; and identifying information indicating the defective pixel using the image information.

4. The method of claim 1, wherein the identifying comprises:

sensing a position of the defective pixel via a sensor operatively coupled with the display.

5. The method of claim 1, wherein each of the plurality of pixels corresponds to one of a plurality of colors comprising red, green, blue, or white.

6. The method of claim 1, wherein each of the plurality of pixels comprises a plurality of pixels expressing a same color selected from among at least one color comprising red, green, blue, or white.

7. The method of claim 1, wherein the arrangement includes a pixel corresponding to a third color located in the first pixel group, and pixels corresponding to a first color, a second color, and the third color, which are located in the second pixel group.

8. An electronic device comprising:

a display panel driven by each of a plurality of control signals corresponding to a plurality of pixels;

a processor configured to:

identify, as a defective pixel, at least one of the plurality of pixels; and compensate a color of the defective pixel using at least one pixel of a second pixel group adjacent to a first pixel group including the defective pixel from among a plurality of pixel groups of the display panel, wherein the processor is further configured to:

turn off both a red pixel and a blue pixel in the first pixel group, if the defective pixel is one of the red pixel or the blue pixel, form an arrangement comprising at least one pixel in the first pixel group, and the at least one pixel in the second pixel group, and operate the arrangement as a pixel group to compensate the color of the defective pixel.

9. The electronic device of claim 8, wherein the processor is configured to:

receive at least one of a quantity, coordinates, a position, an identifier, and a color of the defective pixel.

10. The electronic device of claim 8, further comprising a storage module configured to store information about the defective pixel of the display panel, wherein the processor is configured to receive the information from the storage module.

11. The electronic device of claim 8, wherein the processor is configured to:

detect a position of the defective pixel via a sensor operatively coupled with the electronic device.

12. The electronic device of claim 8, wherein the processor is configured to:

control at least one of a second control signal corresponding to at least one pixel of the first pixel group, and a third control signal corresponding to the second pixel group, based at least in part on a first control signal corresponding to the defective pixel.

13. The electronic device of claim 8, wherein each of the pixel groups is configured by an arrangement of some adjacent pixels in at least one of rhombic-type, bar-type, triangular-type, L6 W-type, Red/Green/Blue (RGB) stripe-type, square-type, rectangular-type, pentagonal-type, or hexagonal-type structures.

14. A non-transitory storage medium configured to store instructions, wherein the instructions are configured for at least one processor to perform at least one operation when being executed by the at least one processor, the at least one operation comprising:

identifying, as a defective pixel, at least one of a plurality of pixels of a display; and compensating a color of the defective pixel using at least one pixel of a second pixel group adjacent to a first pixel group including the defective pixel from among a plurality of pixel groups of the display, wherein the compensating comprises:

turning off both a red pixel and a blue pixel in the first pixel group, if the defective pixel is one of the red pixel or the blue pixel, forming an arrangement comprising at least one pixel in the first pixel group, and the at least one pixel in the second pixel group, and operating the arrangement as a pixel group to compensate the color of the defective pixel.

15. The non-transitory storage medium of claim 14, wherein the identifying comprises:

receiving information about at least one of a quantity, coordinates, a position, an identifier, or a color of the defective pixel.

16. The non-transitory storage medium of claim 14, wherein the identifying comprises:

receiving image information obtained by capturing a display state of the display; and identifying information indicating the defective pixel using the image information.

17. The non-transitory storage medium of claim 14, wherein the identifying comprises:

Sensing a position of the defective pixel via a sensor operatively coupled with the display.

18. The non-transitory storage medium of claim 14, wherein the arrangement includes a pixel corresponding to a third color located in the first pixel group, and pixels corresponding to a first color, a second color, and the third color, which are located in the second pixel group.

* * * * *